US010868370B2

(12) United States Patent
Saitou et al.

(10) Patent No.: US 10,868,370 B2
(45) Date of Patent: Dec. 15, 2020

(54) WIRELESS COMMUNICATION APPARATUS AND ANTENNA DEVICE

(71) Applicant: THE UNIVERSITY OF ELECTRO-COMMUNICATIONS, Chofu (JP)

(72) Inventors: Akira Saitou, Chofu (JP); Hiroto Otsuka, Chofu (JP); Kazuhiko Honjo, Chofu (JP); Ryo Ishikawa, Chofu (JP)

(73) Assignee: THE UNIVERSITY OF ELECTRO-COMMUNICATIONS, Tokyo (JP)

( * ) Notice: Subject to any disclaimer, the term of this patent is extended or adjusted under 35 U.S.C. 154(b) by 0 days.

(21) Appl. No.: 16/614,762

(22) PCT Filed: May 1, 2018

(86) PCT No.: PCT/JP2018/017420

§ 371 (c)(1),
(2) Date: Nov. 18, 2019

(87) PCT Pub. No.: WO2018/216438

PCT Pub. Date: Nov. 29, 2018

(65) Prior Publication Data

US 2020/0203852 A1 Jun. 25, 2020

(30) Foreign Application Priority Data

May 24, 2017 (JP) ..... 2017-102931

(51) Int. Cl.

| | |
|---|---|
| ***H01Q 21/24*** | (2006.01) |
| ***H01Q 21/06*** | (2006.01) |
| ***H01Q 25/00*** | (2006.01) |
| ***H01Q 7/00*** | (2006.01) |

(52) U.S. Cl.
CPC ..... *H01Q 21/24* (2013.01); *H01Q 7/00* (2013.01); *H01Q 21/06* (2013.01); *H01Q 25/00* (2013.01)

(58) Field of Classification Search
CPC ..... H01Q 21/24; H01Q 7/00; H01Q 21/06; H01Q 25/00; H01Q 21/28
See application file for complete search history.

(56) References Cited

U.S. PATENT DOCUMENTS 2,166,750 A * 7/1939 Carter ..... H01Q 7/00 343/742
2,818,562 A * 12/1957 Carter ..... H01Q 21/08 343/742

(Continued)

FOREIGN PATENT DOCUMENTS

JP H09-260925 A 10/1997
JP 2015-231108 A 12/2015

(Continued)

OTHER PUBLICATIONS

Saitou et al., "Four-value Multiplexing Orbital Angular Momentum Communication Scheme Using Loop Antenna Arrays," Proceedings of the Asia-Pacific Microwave Conference 2016.

(Continued)

*Primary Examiner* — Dimary S Lopez Cruz
*Assistant Examiner* — Michael M Bouizza
(74) *Attorney, Agent, or Firm* — Oliff PLC

(57) ABSTRACT

Circular loop antenna elements of each of a transmitting antenna 100 and a receiving antenna 200 have different perimeters of approximately integral multiples of a wavelength determined from a wireless communication frequency. The transmitting antenna 100 and the receiving antenna 200 include first circular loop antenna groups 100A and 200A concentrically disposed on the same plane and second circular loop antenna groups 100B and 200B includ- (Continued)

ing circular loop antenna elements of the same perimeter as that of a plurality of circular loop antenna elements of the first circular loop antenna group. An angular position of a terminal for connecting power supply units to circular loop antenna elements having the same perimeter is set to an angular position rotated by $(2l+1)\pi/2m_i$ (where l is any integer, and $m_i$ is a value of $m_1$ to $m_N$ that are approximately integral multiples of a wavelength) in the first and second circular loop antenna groups.

9 Claims, 14 Drawing Sheets

(56) References Cited

U.S. PATENT DOCUMENTS 5,625,371 A * 4/1997 Miller ..... H01Q 7/00 343/742
6,057,803 A 5/2000 Kane et al.
2015/0357710 A1 12/2015 Li
2016/0028163 A1 1/2016 Li et al.
2016/0041523 A1 2/2016 Ashrafi et al.
2016/0359236 A1 12/2016 Sundaram
2017/0117626 A1 4/2017 Sajuyigbe et al.
2017/0331543 A1 11/2017 Hirabe et al.
2019/0025760 A1 1/2019 Ashrafi et al.
2019/0229795 A1 7/2019 Hirabe et al.

FOREIGN PATENT DOCUMENTS

WO 2012/084039 A1 6/2012
WO 2014/199451 A1 12/2014
WO 2016/063315 A1 4/2016

OTHER PUBLICATIONS

Jul. 3, 2018 International Search Report issued in International Patent Application No. PCT/JP2018/017420.

* cited by examiner

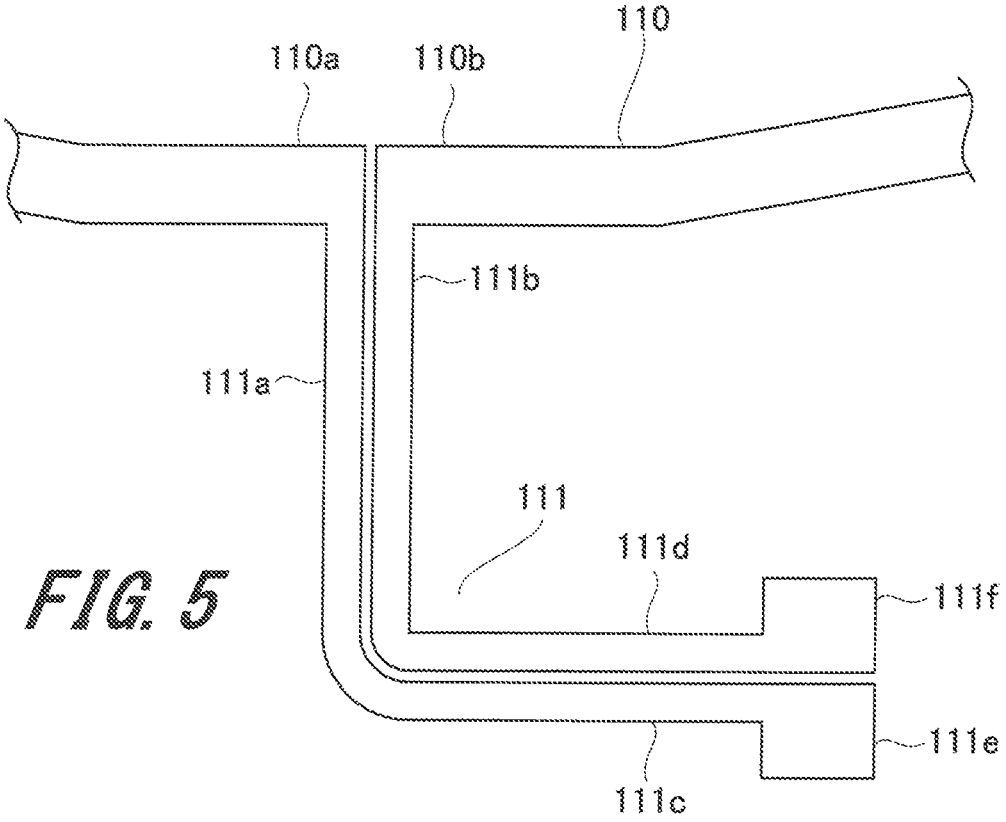
FIG. 5
FIG. 6
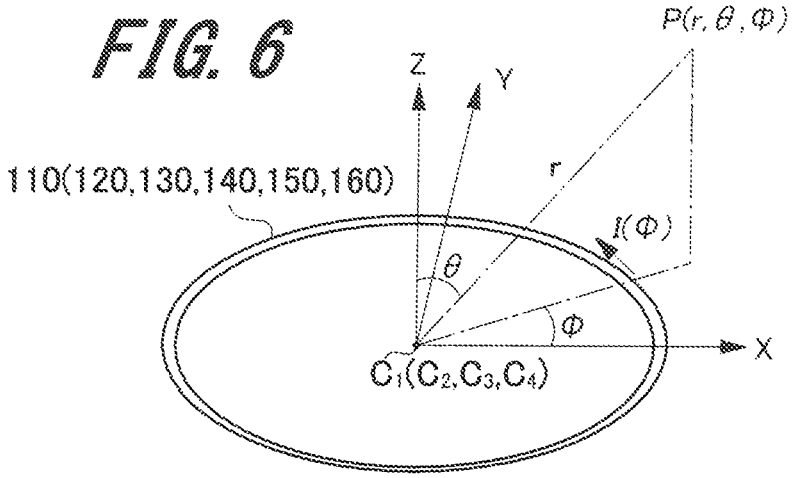

WIRELESS COMMUNICATION APPARATUS AND ANTENNA DEVICE

TECHNICAL FIELD

The present invention relates to a wireless communication apparatus and an antenna device, and more particularly to a wireless communication apparatus capable of simultaneously and wirelessly transmitting data on a plurality of systems by using the same frequency band and an antenna device used for the wireless communication apparatus.

BACKGROUND ART

In recent years, rich content on the Internet and the spread of ultrahigh-speed networks over optical lines and wireless networks to end users have caused rapid progress to the advanced information society that enables information provision tailored to individual needs of "anytime, anywhere, and with anyone" and furthermore "only now, only here, and only you". Big data collection by communication without involving humans over sensor networks is also progressing in parallel. Various systems, such as mobile phones, worldwide interoperability for microwave access (WiMAX), wireless local area networks (LAN), Bluetooth (registered trademark), ultra wide band (UWB), and ZigBee, are provided as wireless systems that support the tendency.

Services that seamlessly connect these systems and provide a combination of the systems are also progressing. These wireless systems perform communication by occupying a specific communication band. In particular, a wide frequency band is necessary for transmitting a large amount of data fast. Unfortunately, these wireless systems require many valuable frequency resources. For this reason, the importance of techniques capable of improving a transmission rate per frequency (bit/Hz), obtained by dividing a transmission information amount by a bandwidth, as an index of effective use is increased.

A technique called multiple-input and multiple-output (MIMO), in which multiple antennas are disposed on a transmission side and a reception side, is known as one technique capable of improving the transmission rate per frequency. MIMO is an approach of spatial multiplexing of performing multiplexing by using difference in propagation characteristics in the same time and the same band. For example, when each of the transmission side and the reception side has n antennas (n is any integer), the relation between the voltage current of a transmitting antenna and the voltage current of a receiving antenna can be uniquely determined by a transfer function (e.g., Z matrix) of a propagation path, and is expressed as a square matrix of n rows×n columns.

When eigenvectors of the matrix are used, the square matrix of n rows×n columns can be diagonalized, and the transfer function in relation to n eigenvectors is independent, which enables n-fold multiplexing. Unfortunately, mixed signals are mathematically separated in MIMO, and thus complicated signal processing is required. Since a plurality of antennas is operated in cooperation, there also arises a problem that system configuration is complicated.

In light of such situations, orbital angular momentum (OAM) communication has recently been proposed as an approach of multiplexing at the same frequency. The approach uses a phenomenon in which interaction is allowed only when the orbital angular momentum of an electromagnetic field is preserved. In the approach, transmission is performed by causing an electromagnetic wave to hold information on the orbital angular momentum (OAM).

In wave motion, having a beam cross section of a Gaussian distribution system, such as a laser beam, the phase space distribution, in relation to an orientation $\varphi$ in a cross section, of a normal wave is constant. In contrast, in an OAM wave, linear change to the orientation p occurs in accordance with $\exp(jm\varphi)$ (where m is a mode order of the OAM wave and called a magnetic quantum number), and the same phase surface advances spirally.

In optical communication, such an OAM wave can be achieved relatively easily by using a laser and a hologram or a spiral phase plate. In contrast, in a microwave, transmission and reception methods of an eigenmode and methods of transmitting a focused beam are greatly different from those in the optical communication, and thus the OAM wave is not easily achieved.

For example, Patent Literature 1 describes a technique of generating an OAM wave with an electromagnetic wave by spirally cutting a parabolic antenna in imitation of configuration in an optical OAM communication and shifting a reflection surface by an integral multiple of wavelength.

Patent Literature 2 describes a technique of generating an electromagnetic field, in which a phase surface changes to $\exp(jm\varphi)$ at a reception position on the circumference, by disposing array type antenna elements on the circumference and shifting the phases between antenna elements at a constant interval. This technique creates different OAM modes by discretely changing the phase amount to be shifted, and enables multiplexing between modes.

CITATION LIST

Patent Literature

Patent Literature 1: WO2014/199451 A
Patent Literature 2: JP 2015-231108 A

SUMMARY OF INVENTION

Technical Problem

As described in Patent Literature 1, an OAM wave can be generated by spirally cutting a parabolic antenna and shifting a reflection surface by an integral multiple of wavelength.

Manufacturing the parabolic antenna having a special shape with cuts, however, is not easy, and has a problem that mass production is difficult.

As described in Patent Literature 2, when array type antenna elements are disposed on circumference, complicated signal processing is necessary for extracting a signal in each mode based on the correlation between reception signals between antennas similarly to the case of general MIMO communication. To create an electromagnetic field that rotates at $\exp(jm\varphi)$, a phase shifter for giving a constant phase difference between antennas needs to be disposed on a transmission side. When the array type antenna elements are disposed on the circumference, there arises a problem that the configurations of a transmission circuit and a reception circuit are complicated.

As described above, conventionally proposed techniques for improving a transmission rate per frequency have a problem that a complicated antenna is required and a problem that a transmission/reception circuit having a complicated configuration is required. Improving the transmission rate per frequency with a simpler configuration has been desired.

An object of the invention is to provide a wireless communication apparatus and an antenna device capable of improving the transmission rate per frequency with a simple configuration.

Solution to Problem

A wireless communication apparatus of the invention has a transmitting antenna and a receiving antenna that receives a wireless signal transmitted from the transmitting antenna.

The transmitting antenna and the receiving antenna include: a first circular loop antenna group in which N (N is an integer of two or more) circular loop antenna elements are concentrically disposed on a same plane, the N circular loop antenna elements having different perimeters of $m_1$, $m_2$, . . . , and $m_N$ times that are approximately integral multiples of a wavelength determined from a wireless communication frequency; a second circular loop antenna group, in which N circular loop antenna elements concentrically disposed on a same plane different from that for the first circular loop antenna group have a same perimeter as the N circular loop antenna elements of the first circular loop antenna group; and a plurality of power supply units that are individually connected to circular loop antenna elements in each of the first and second circular loop antenna groups.

A central axis of the N circular loop antenna elements of the transmitting antenna and a central axis of the N circular loop antenna elements of the receiving antenna are disposed substantially linearly.

An angular position where power supply units are connected to circular loop antenna elements having the same perimeter is set to an angular position rotated by $(2l+1)\pi/2m_i$ (where l is any integer, and $m_i$ is a value of $m_i$ to $m_N$ that are approximately integral multiples of a wavelength) in the first and second circular loop antenna groups.

An antenna device of the invention includes: a first circular loop antenna group in which N (N is an integer of two or more) circular loop antenna elements are concentrically disposed on a same plane, the N circular loop antenna elements having different perimeters of $m_1$, $m_2$, . . . , and $m_N$ times that are approximately integral multiples of a wavelength determined from a wireless communication frequency; a second circular loop antenna group, in which N circular loop antenna elements concentrically disposed on a same plane different from that for the first circular loop antenna group have a same perimeter as the N circular loop antenna elements of the first circular loop antenna group; and a plurality of power supply units that are individually connected to circular loop antenna elements in each of the first and second circular loop antenna groups.

An angular position where power supply units are connected to circular loop antenna elements having the same perimeter is set to an angular position rotated by $(2l+1)\pi/2m_i$ (where l is any integer, and $m_i$ is a value of $m_i$ to $m_N$ that are approximately integral multiples of a wavelength) in the first and second circular loop antenna groups.

BRIEF DESCRIPTION OF DRAWINGS

FIG. 5 is an enlarged plan view illustrating the vicinity of a power supply unit of the antenna according to the first embodiment of the invention.

FIG. 6 illustrates the current distribution of the antenna and an observation point in an electromagnetic field on a polar coordinate system, according to the first embodiment of the invention.

DESCRIPTION OF EMBODIMENTS

1. First Embodiment

A first embodiment of the invention will be described below with reference to FIGS. 1 to 24.

[1-1. Configuration of Entire System]

Figure 1:
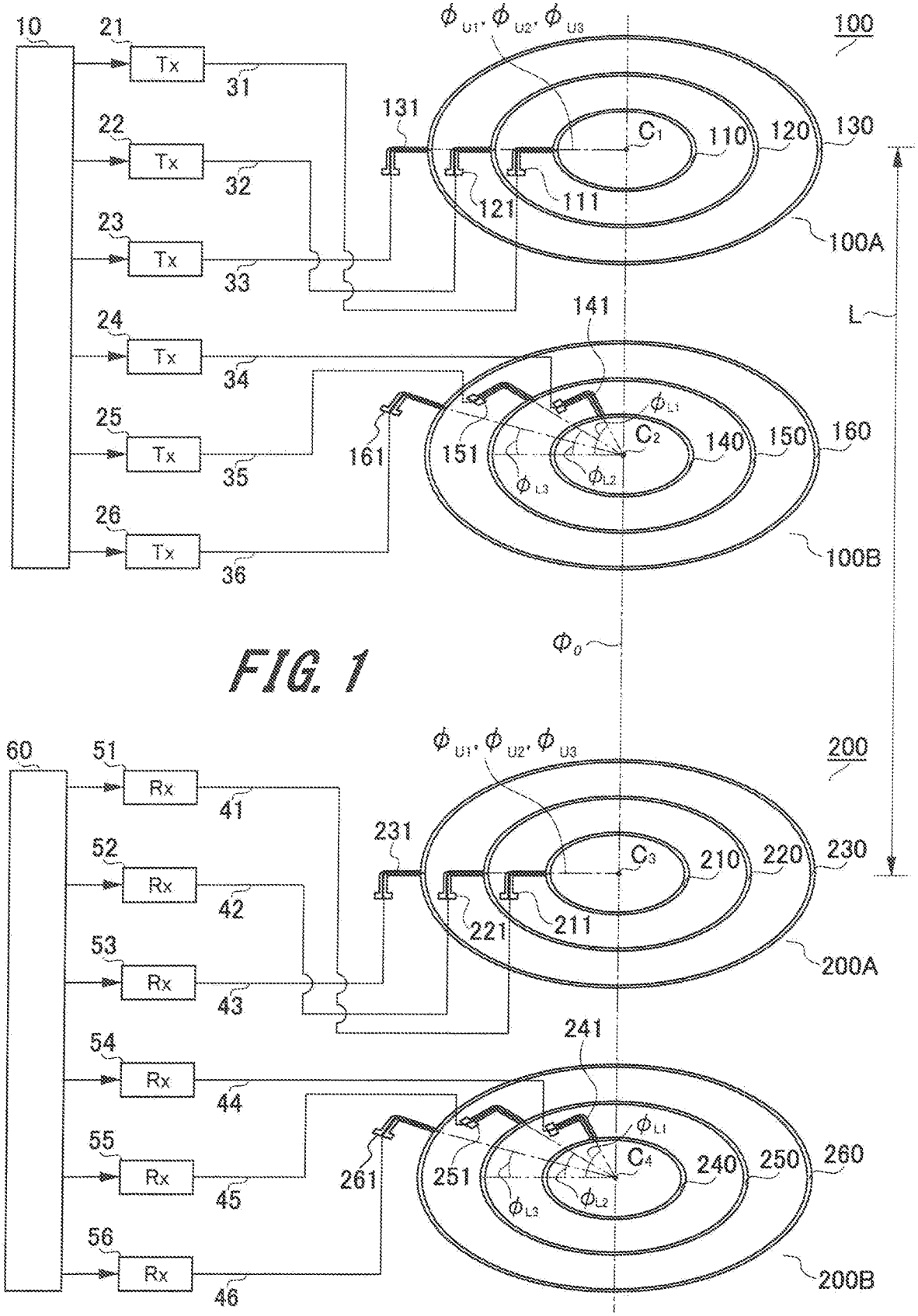
FIG. 1 is a configuration diagram illustrating an example of the entire configuration of a wireless communication apparatus according to a first embodiment of the invention.

FIG. 1 illustrates a configuration example of an entire wireless communication apparatus of the first embodiment.

Figure 2:
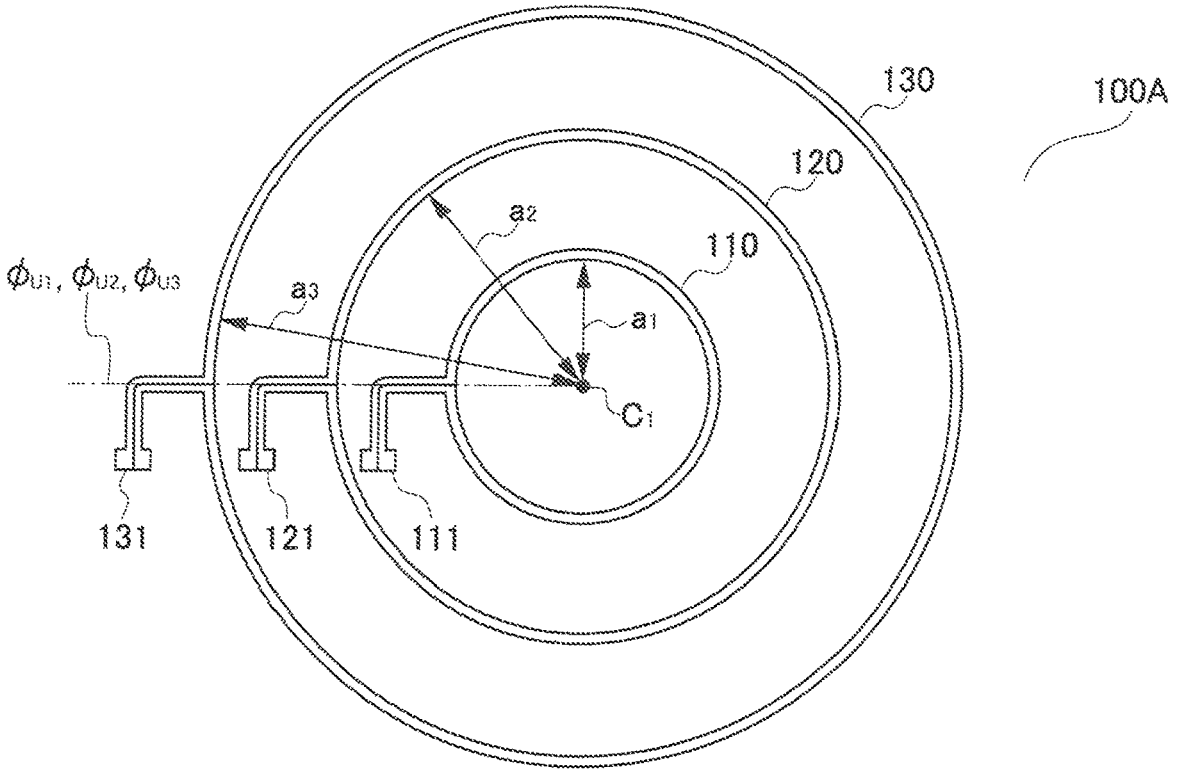
FIG. 2 is a plan view illustrating antenna configuration (upper surface pattern) according to the first embodiment of the invention.
Figure 3:
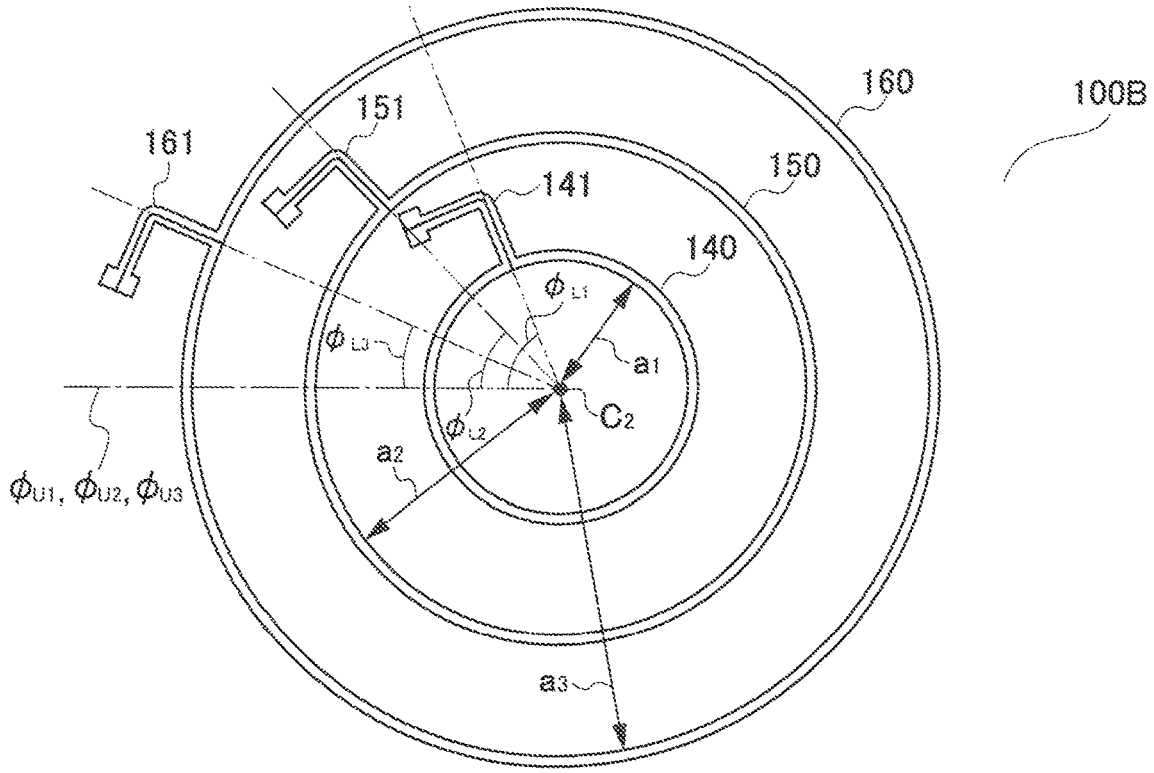
FIG. 3 is a plan view illustrating antenna configuration (lower surface pattern) according to the first embodiment of the invention.

The wireless communication apparatus of the first embodiment performs wireless communication from a transmitting antenna 100 to a receiving antenna 200 at a relatively short distance. The transmitting antenna 100 and the receiving antenna 200 have the same configuration, and each antenna includes a plurality of (here, six) circular loop antenna elements 110 to 160 and 210 to 260. FIGS. 2 and 3 illustrate the configurations of the upper and lower surfaces of the transmitting antenna 100. The receiving antenna 200 also has the same shape as the transmitting antenna 100.

Figure 4:
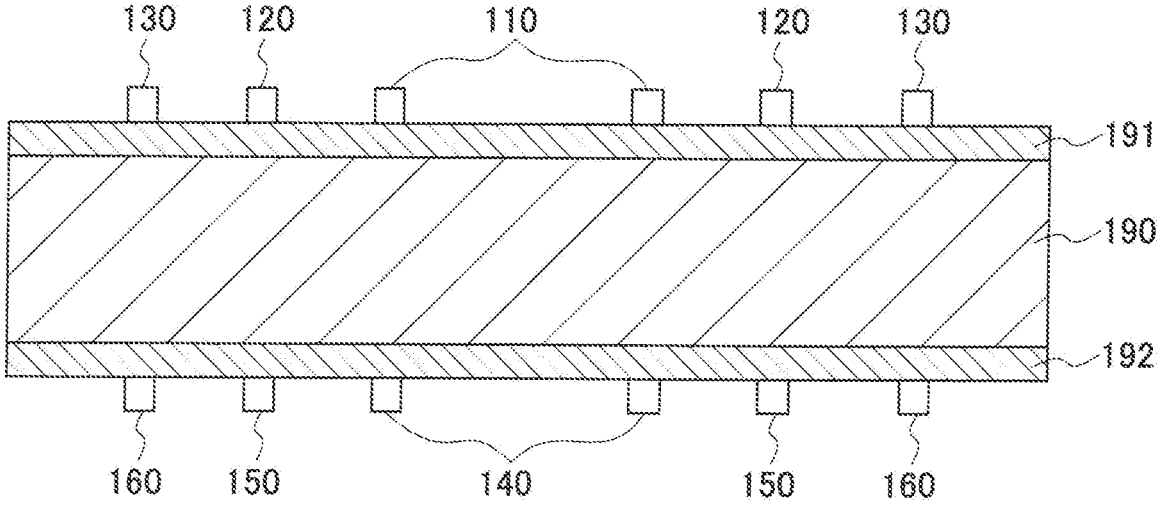
FIG. 4 is a cross-sectional view of an antenna according to the first embodiment of the invention.

That is, the transmitting antenna 100 includes six circular loop antenna elements 110, 120, 130, 140, 150, and 160. The six circular loop antenna elements 110 to 160 are divided into a first circular loop antenna group 100A and a second circular loop antenna group 100B. With respect to the first circular loop antenna group 100A and the second circular loop antenna group 100B, as illustrated in FIG. 4, the first circular loop antenna group 100A is disposed on a dielectric layer 191 on the front side of one substrate 190, and the second circular loop antenna group 100B is disposed on a dielectric layer 192 on the back side of the substrate 190.

The first circular loop antenna group 100A includes three circular loop antenna elements 110, 120, and 130. The three circular loop antenna elements 110, 120, and 130 are disposed on the same plane (dielectric layer 191 on the front side of the substrate 190) with central positions $C_1$ coinciding with each other.

The second circular loop antenna group 100B includes three circular loop antenna elements 140, 150, and 160. The three circular loop antenna elements 140, 150, and 160 are disposed on the same plane (dielectric layer 192 on the back side of the substrate 190) with central positions $C_2$ coinciding with each other.

The receiving antenna 200 has the same shape as the transmitting antenna 100. The receiving antenna 200 includes six circular loop antenna elements 210, 220, 230, 240, 250, and 260, which are divided into a first circular loop antenna group 200A and a second circular loop antenna group 200B.

The first circular loop antenna group 200A includes three circular loop antenna elements 210, 220, and 230. The three circular loop antenna elements 210, 220, and 230 are disposed on the same plane with central positions $C_1$ coinciding with each other.

The second circular loop antenna group 200B includes three circular loop antenna elements 240, 250, and 260. The three circular loop antenna elements 240, 250, and 260 are disposed on the same plane with central positions $C_2$ coinciding with each other.

The circular loop antenna elements 110 to 160 of the transmitting antenna 100 and the circular loop antenna elements 210 to 260 of the receiving antenna 200 include a circular conductor that is interrupted at a power supply unit as described later. The conductor is not annularly continuous (See FIG. 5).

Each of the circular loop antenna elements 110 to 160 and 210 to 260 constituting the transmitting antenna 100 and the receiving antenna 200 is independent, and has a length that is approximately an integral multiple of a wavelength determined from a frequency wirelessly transmitted by a wireless communication apparatus.

Here, the circular loop antenna element 110 of the first circular loop antenna group 100A and the circular loop antenna element 140 of the second circular loop antenna group 100B have the same perimeter and an equal loop radius. Similarly, the circular loop antenna element 120 and the circular loop antenna element 150 have the same perimeter and an equal loop radius. The circular loop antenna element 130 and the circular loop antenna element 160 also have the same perimeter and an equal loop radius.

In the receiving antenna 200 as well, the circular loop antenna element 210 of the first circular loop antenna group 200A and the circular loop antenna element 240 of the second circular loop antenna group 200B have the same perimeter and an equal loop radius. Similarly, the circular loop antenna element 220 and the circular loop antenna element 250 also have the same perimeter and an equal loop radius. The circular loop antenna element 230 and the circular loop antenna element 260 further have the same perimeter and an equal loop radius.

Note that, although each element of the first circular loop antenna groups 100A and 200A and each element of the second circular loop antenna groups 100B and 200B are described to have an equal loop radius, each element may have a substantially equal radius of a value that deviates a little from a perfectly equal loop radius to compensate for slight deviation of an optimum value due to the interference between antennas.

Details of the length of each of the circular loop antenna elements 110 to 160 and 210 to 260 will be described later.

As illustrated in FIG. 1, the central position $C_1$ of the first circular loop antenna group 100A and the central position $C_2$ of the second circular loop antenna group 100B of the transmitting antenna 100 coincide with each other as seen from the direction orthogonal to the plane on which each of the circular loop antenna elements 110 to 160 is disposed. The central positions $C_1$ and $C_2$ are placed on a central axis $\varphi_0$.

Similarly, a central position $C_3$ of the first circular loop antenna group 200A and a central position $C_4$ of the second circular loop antenna group 200B of the receiving antenna 200 coincide with each other as seen from the direction orthogonal to the plane on which each of the circular loop antenna elements 210 to 260 is disposed. The central positions $C_3$ and $C_4$ are placed on a place through which the central axis $\varphi_0$ passes.

Therefore, the central axis $\varphi_0$ passes through the central positions $C_1$ to $C_4$ of all the circular loop antenna elements 110 to 160 of the transmitting antenna 100 and all the circular loop antenna elements 210 to 260 of the receiving antenna 200. Although it is desirable in terms of characteristics that each of the central positions $C_1$ to $C_4$ perfectly coincides with the central axis $\varphi_0$, transmission is possible even if each of the central positions $C_1$ to $C_4$ is somewhat deviated from the central axis $\varphi_0$.

A distance L between the transmitting antenna 100 and the receiving antenna 200 is set to a relatively short distance of, for example, approximately several millimeters to several tens of centimeters. Note, however, that, as will be described in a later-described variation, the transmission distance L may be extended by a paraboloid, which is a reflecting member having a paraboloid surface.

In description of the configuration of the transmission side, a transmission data generation unit 10 generates six transmission data sequences, and supplies the generated six transmission data sequences to six transmission units 21, 22, 23, 24, 25, and 26. Each of the transmission units 21, 22, 23, 24, 25, and 26 is a transmission wave of the same frequency modulated in accordance with the supplied transmission data sequence. The transmission wave obtained at each of the transmission units 21, 22, 23, 24, 25, and 26 is supplied to power supply units 111, 121, 131, 141, 151, and 161 via signal lines 31, 32, 33, 34, 35, and 36. The power supply units 111, 121, 131, 141, 151, and 161 are connected to six circular loop antenna elements 110, 120, 130, 140, 150, and 160, respectively.

The six circular loop antenna elements 110, 120, 130, 140, 150, and 160 wirelessly transmit the transmission wave supplied to each of the power supply units 111, 121, 131, 141, 151, and 161.

Here, terminal positions, where the power supply units 111, 121, and 131 are connected, in the three circular loop antenna elements 110, 120, and 130 of the first circular loop antenna group 100A of the transmitting antenna 100 are set at the same angular position. In contrast, terminal positions, where the power supply units 141, 151, and 161 are connected, in three circular loop antenna elements 140, 150, and 160 of the second circular loop antenna group 100B of the transmitting antenna 100 are set at angular positions shifted by predetermined angles from the terminal positions to which the power supply units 111, 121, and 131 are connected to the three circular loop antenna elements 110, 120, and 130 on the side of the first circular loop antenna group 100A.

For example, when terminal positions $\varphi_{U1}$, $\varphi_{U2}$, and $\varphi_{U3}$, where the power supply units 111, 121, and 131 are connected to the three circular loop antenna elements 110, 120, and 130 of the first circular loop antenna group 100A, are defined as a reference position (0 degrees) (these terminal positions $\varphi_{U1}$, $\varphi_{U2}$, and $\varphi_{U3}$ are the same angular position), a terminal position where the power supply unit 141 is connected to the circular loop antenna element 140 of the second circular loop antenna group 100B is an angular position $\varphi_{L1}$ shifted from the reference position. Similarly, the terminal position where the power supply unit 151 is connected to the circular loop antenna element 150 of the second circular loop antenna group 100B is an angular position $\varphi_{L2}$ shifted from the reference position. Furthermore, the terminal position where the power supply unit 161 is connected to the circular loop antenna element 160 of the second circular loop antenna group 100B is an angular position $\varphi_{L3}$ shifted from the reference position.

Here, the angular positions $\varphi_{L3}$, $\varphi_{L2}$, and $\varphi_{L1}$ are $\pi/6$, $\pi/4$, and $\pi/2$, respectively. Details of the setting of these angles will be described later.

Signals wirelessly transmitted from the six circular loop antenna elements 110, 120, 130, 140, 150, and 160 are individually received by the six circular loop antenna elements 210, 220, 230, 240, 250, and 260 of the receiving antenna 200. The six circular loop antenna elements 210, 220, 230, 240, 250, and 260 include different power supply units 211, 221, 231, 241, 251, and 261. The reception signal obtained at each of the power supply units 211, 221, 231, 241, 251, and 261 is supplied to individual reception units 51, 52, 53, 54, 55, and 56 via signal lines 41, 42, 43, 44, 45, and 46. Each of the reception units 51, 52, 53, 54, 55, and 56 demodulates a signal transmitted at the same frequency to obtain a reception data sequence. The reception data sequence obtained at each of the reception units 51, 52, 53, 54, 55, and 56 is supplied to a reception data processing unit 60.

The terminal positions where the power supply units 211 to 261 are connected to the six circular loop antenna elements 210 to 260 of the receiving antenna 200 are the same as the terminal positions where the power supply units 111 to 161 are connected to the six circular loop antenna elements 110 to 160 of the transmitting antenna 100. The terminal positions where the power supply units 141, 151, and 161 are connected to the circular loop antenna elements 140, 150, and 160 of the second circular loop antenna group 200B is shifted from the reference position by the angles $\varphi_{L1}$, $\varphi_{L2}$, and $\varphi_{L3}$.

[1-2. Configuration of Antenna Device]

FIGS. 2 to 5 illustrate the configuration of the transmitting antenna 100. The receiving antenna 200 has the same configuration as the transmitting antenna 100, and the description in FIGS. 2 to 5 can be applied.

FIGS. 2 and 3 are plan views of the first circular loop antenna group 100A (FIG. 2) and the second circular loop antenna group 100B (FIG. 3) of the transmitting antenna 100 as seen from the upper side of the central axis $\varphi_0$ in FIG. 1.

As illustrated in FIG. 2, the three circular loop antenna elements 110, 120, and 130 of the first circular loop antenna group 100A of the transmitting antenna 100 are concentrically disposed. The three circular loop antenna elements 140, 150, and 160 of the second circular loop antenna group 100B are also concentrically disposed under the same conditions as that of the first circular loop antenna group 100A. The length of a conductor constituting each of the circular loop antenna elements 110, 120, and 130 is set to approximately an integral multiple of a wavelength determined from the frequency of a transmission signal.

That is, when the wavelength of a wireless transmission signal is $\lambda$, the perimeters of the circular loop antenna elements 110, 120, and 130 are set to be approximately an integral multiple of the wavelength $\lambda$. That is, the radii from the central positions $C_1$ of concentric circles to the centers of conductors constituting each of the circular loop antenna elements 110, 120, and 130 are defined as $a_1$, $a_2$, and $a_3$, and the radii $a_1$ to $a_3$ are indicated as $a_i$ (i is an integer of 1 to 3), the radius $a_i$ of each of the circular loop antenna elements 110 to 130 and 140 to 160 is expressed by the following [Expression 1].

$$a_i = \frac{n_i \lambda}{2\pi} \qquad \text{[Expression 1]}$$

Here, $n_i$ is any natural number, and is a natural number having a different value for each of the circular loop antenna elements 110 to 130 (and for each of the circular loop antenna elements 140 to 160).

When each of the circular loop antenna elements 110, 120, and 130 of the first circular loop antenna group 100A is disposed as illustrated in FIG. 2, the innermost circular loop antenna element 110 has the minimum perimeter, and the outermost circular loop antenna element 130 has the maximum perimeter. Similarly, when each of the circular loop antenna elements 140, 150, and 160 of the second circular loop antenna group 100B is disposed as illustrated in FIG. 3, the innermost circular loop antenna element 140 has the minimum perimeter, and the outermost circular loop antenna element 160 has the maximum perimeter. That is, $n_i$ is a natural number that increases in order, for example, 1, 2, 3, from the inside to the outside in each of the circular loop antenna groups 100A and 100B. The case where $n_i$ is a continuous value that increases one by one is one example, and a randomly increased value may be used.

FIG. 4 illustrates a cross-sectional shape of the transmitting antenna 100.

The three circular loop antenna elements 110 to 130 of the first circular loop antenna group 100A of the transmitting antenna 100 are disposed on the dielectric layer 191 on the front side of the substrate 190. The three circular loop antenna elements 140 to 160 of the second circular loop antenna group 100B are disposed on the dielectric layer 192 on the back side of the substrate 190.

Low dielectric constant foam such as hard plastic closed-cell foam (trade name Rohacell) is used for the substrate 190. Alternatively, the substrate 190 may be replaced with free space.

For example, a glass/epoxy substrate (substrate called, for example, FR-4) is used for the dielectric layers 191 and 192.

When the circular loop antenna groups 100A and 100B are respectively disposed on the dielectric layers 191 and 192, the wavelength is shortened with the dielectric constant $\varepsilon_e$ of the dielectric substrate. The radius $a_1$ of each of the circular loop antenna elements 110 to 130 and 140 to 160 is thus illustrated in the following [Expression 2]. A wavelength $\lambda_0$ here indicates a wavelength in free space.

$$a_i = \frac{n_i \lambda_0}{2\pi\sqrt{\varepsilon_e}} \quad i = 1, 2, 3, 4, \ldots \qquad \text{[Expression 2]}$$

A conductor width d of each of the circular loop antenna elements 110, 120, and 130 is preferably 1/10 or less of the loop radius. For example, each of the circular loop antenna elements 110 to 130 and 140 to 160 has a conductor width d that is any value of 1/10 or less of the radius of the innermost circular loop antenna elements 110 and 140. Alternatively, the conductor width d may be increased toward the outer circumferential side so that each of the circular loop antenna elements 110 to 130 and 140 to 160 has the conductor width d that is 1/10 or less of each radius.

As already described, the angular positions $\varphi_{U1}$, $\varphi_{U2}$, and $\varphi_{U3}$ and the angular positions $\varphi_{L1}$, $\varphi_{L2}$, and $\varphi_{L3}$ are set at different angular positions. At the angular positions $\varphi_{U1}$, $\varphi_{U2}$, and $\varphi_{U3}$, a terminal connects the power supply units 111, 121, and 131 to the circular loop antenna elements 110, 120, and 130 of the first circular loop antenna group 100A, respectively. At the angular positions $\varphi_{L1}$, $\varphi_{L2}$, and $\varphi_{L3}$, a terminal connects the power supply units 141, 151, and 161 to the circular loop antenna elements 140, 150, and 160 of the second circular loop antenna group 100B, respectively.

That is, when terminal positions (positions of $\varphi_{U1}$, $\varphi_{U2}$, and $\varphi_{U3}$), where the power supply units 111, 121, and 131 are connected to the three circular loop antenna elements 110, 120, and 130 of the first circular loop antenna group 100A, are defined as a reference, a terminal position where the power supply unit 141 is connected to the circular loop antenna element 140 of the second circular loop antenna group 100B is shifted by the angle $\varphi_{L1}$ from the reference position $\varphi_\alpha$. Similarly, the terminal position where the power supply unit 151 is connected to the circular loop antenna element 150 of the second circular loop antenna group 100B is shifted by the angle $\varphi_{L2}$ from the reference position $\varphi_\alpha$. The terminal position where the power supply unit 161 is connected to the circular loop antenna element 160 of the second circular loop antenna group 100B is shifted by the angle $\varphi_{L3}$ from the reference position $\varphi_\alpha$.

In general, loops having a loop radius $m_i$ times longer than a wavelength in the first circular loop antenna group 100A and the second circular loop antenna group 100B are placed at the position rotated by an angle of $(2l+1)\pi/2m_i$. Here, l may be any integer. Here, the angular positions of the terminals for connecting the power supply units 111, 121, and 131 of the first circular loop antenna group 100A on the upper surface side are defined as $\varphi_{U1}$, $\varphi_{U2}$, and $\varphi_{U3}$. The angular positions of the terminals for connecting the power supply units 141, 151, and 161 of the second circular loop antenna group 100B on the lower surface side are defined as $\varphi_{L1}$, $\varphi_{L2}$, and $\varphi_{L3}$. Here, all of the angular positions $\varphi_{U1}$, $\varphi_{U2}$, and $\varphi_{U3}$ on the side of the first circular loop antenna group 100A have the same angle.

Terminal positions where the power supply units 211, 221, and 231 are respectively connected to the circular loop antenna elements 210, 220, and 230 of the first circular loop antenna group 200A on the side of the receiving antenna 200 and terminal positions where the power supply units 241, 251, and 261 are respectively connected to the circular loop antenna elements 240, 250, and 260 of the second circular loop antenna group 200B are also set at different angular positions under a condition similar to that on the side of the transmitting antenna 100. That is, the angular positions of the terminals for connecting the power supply units 211, 221, and 231 of the first circular loop antenna group 200A on the upper surface side are defined as $\varphi_{U1}$, $\varphi_{U2}$, and $\varphi_{U3}$. The angular positions of the terminals for connecting the power supply units 241, 251, and 261 of the second circular loop antenna group 200B on the lower surface side are defined as $\varphi_{L1}$, $\varphi_{L2}$, and $\varphi_{L3}$.

FIG. 5 is an enlarged view of the detailed configuration of the power supply unit 111 connected to the circular loop antenna element 110.

One end 110*a* and the other end 110*b* are terminal parts of the circular loop antenna element 110. The one end 110*a* and the other end 110*b* are close to each other in a non-conductive state. Linear coupling lines 111*a* and 111*b* are connected to the one end 110*a* and the other end 110*b*, respectively. The coupling lines 111*a* and 111*b* are connected to other linear coupling lines 111*c* and 111*d* disposed at a position where the coupling lines 111*a* and 111*b* are bent by approximately 90°. Pads 111*e* and 111*f*, which are differential input/output terminals, are formed at ends of the coupling lines 111*c* and 111*d*, respectively.

Differential signals having reverse polarities are supplied from the transmission unit 21 in FIG. 1 to the two pads 111*e* and 111*f*.

The power supply unit 111 having the configuration in FIG. 5 functions as a balun that performs actual impedance conversion. The power supply unit 111 having the function of the balun can adjusted, for example, the input impedance of the circular loop antenna element 110 to 50Q, which is the impedance of a coaxial cable. The configuration of the power supply unit 111 in FIG. 5 is one example, and another balun (balance-unbalance converter) known as a power supply unit for an antenna may be applied to the power supply unit 111.

The power supply units 121, 131, 141, 151, and 161 connected to the other circular loop antenna elements 120, 130, 140, 150, and 160 in the transmitting antenna 100 have configurations similar to that of the power supply unit 111 in FIG. 5. Differential signals are supplied from transmission units 22, 23, 24, 25 and 26 respectively corresponding to the power supply units 121, 131, 141, 151, and 161.

The power supply units 211, 221, 231, 241, 251, and 261 respectively connected to the circular loop antenna elements 210, 220, 230, 240, 250, and 260 of the receiving antenna 200 have configurations similar to that of the power supply unit 111 in FIG. 5. That is, the differential signals received at the circular loop antenna elements 210, 220, 230, 240, 250, and 260 are respectively obtained at pads (having configurations similar to those of the pads 111*e* and 111*f* in FIG. 5) of the power supply units 211, 221, 231, 241, 251, and 261, and the differential signals obtained at the pads are supplied to the reception units 51, 52, 53, 54, 55, and 56.

[1-3. Operation Characteristics of Antenna Device]

Operation characteristics of the transmitting antenna 100 and the receiving antenna 200 will now be described.

First, the characteristics of the individual circular loop antenna elements 110 to 160 and 210 to 260 as a single element will be described.

In the following description of characteristics, the circular loop antenna elements 110, 120, 130, 140, 150, and 160 in FIG. 1 will be referred to as antennas 1, 2, 3, 4, 5, and 6, respectively. When one circular loop antenna element i (i is one of 1 to 6) to be excited is disposed on the XY plane, and the excitation terminal is positioned on the X axis ($\varphi$=0), the current distribution $I_i(\varphi)$ on the circular loop antenna i can be expressed in the following [Expression 3] by performing Fourier series expansion from the symmetry of a conductor. Here, subscripts indicate antenna numbers, and superscripts indicate the expansion order.

$$I_i(\phi) = I_i^0 + 2\sum_{n=1}^{\infty} I_i^n \cos(n\phi) \qquad \text{[Expression 3]}$$

According to [Expression 3], when an antenna $m_i$ having a perimeter $m_i$ times longer than a wavelength is excited, $I_{mi}^{mi}$, which is an expansion coefficient of $\cos(m_i\varphi)$, is overwhelmingly large, and other coefficients are significantly small in the current distribution when the length (perimeter) of the circular loop antenna element is approximately an integral multiple of the wavelength. In the case, $m_i$-order is dominant in the magnetic quantum number mode of a radiation electromagnetic field.

Transmission characteristics of the transmitting antenna 100 and the receiving antenna 200 of the embodiment will be described based on the above-described points.

In the circular loop antenna elements 110 to 160, $m_1$=1, $m_2$=2, and $m_3$=3 are defined for each group. When the smallest circular loop antenna element 110 is excited, $I_1^1$ is thus overwhelmingly large. When the middle-sized circular loop antenna element 120 is excited, $I_2^2$ is overwhelmingly large. When the circular loop antenna element 130 of the maximum size is excited, $I_3^3$ is overwhelmingly large.

For example, when the circular loop antenna 1 of the minimum size is excited, the radiation electromagnetic field of the circular loop antenna is an electromagnetic field having the magnetic quantum number of the first order, and the order of a current expansion coefficient on the antenna can approximate only to the first order. Induced current to another antenna element in the case is known to be generated only between the same orders of current. As a result of further detailed analysis of the situation, it has been found that the current distributions regarding p on a conductor are approximately equal on antennas having an equal loop radius.

When the antenna 1 is excited, current of only the first order is induced on the antenna 1, which induces current of only the first order to another antenna. In contrast, the current of the first order is not induced in an antenna having a different loop radius. Thus, the current of the first order is induced only to the antenna 4 having the same loop radius on the lower surface.

The current distribution $I_4$ (φ) on the antenna 4 is as follows since the current distributions are approximately equal. Since a terminal of an excitation antenna is positioned at φ=0 here, φ will be determined clockwise below. Although the sign of φ is inverted in the case, the value of cos mφ does not change.

$$I_4(\phi)=2I_4^1 \cos \phi \quad \text{[Expression 4]}$$

Here, the terminal position of the antenna 4 (circular loop antenna element 140) is set at φ=π/2 as illustrated in FIGS. 1 to 3, and thus the current of the terminal is given as follows.

$$I_4(\pi/2)=2I_4^1 \cos(\pi/2)=0 \quad \text{[Expression 5]}$$

That is, since no current flows through the terminal of the antenna 4, reception is not performed even though the antenna 4 has the same loop radius. In contrast, when the terminal of the antenna 4 is set in the same direction as the terminals of the antennas 1, 2, and 3, the following is obtained.

$$I_4(0)=2I_4^1 \quad \text{[Expression 6]}$$

When the terminal positions are set at the same angular position in this way, the maximum current flows, so that the operation is different in that reception is performed on a large scale. Similarly, when an antenna i $m_i$ times longer than a wavelength is excited, reception is not performed since an antenna having the different loop radius does not excite the $m_i$-order current. The following current distribution, however, is excited in an antenna i' having the same loop radius on the opposite surface.

$$I_{i'}(\phi)=2I_{i'}^{m_i} \cos(m_i\phi) \quad \text{[Expression 7]}$$

Since the terminal of the antenna i' having the same loop radius on the opposite surface is positioned at $(2l+1)\pi/2m_i$, however, the terminal current is still 0.

$$I_{i'}\left(\frac{(2l+1)\pi}{2m_i}\right)=2I_{i'}^{m_i}\cos\{(l+1/2)\pi\}=0 \quad \text{[Expression 8]}$$

Consequently, when the transmitting antenna 100 and the receiving antenna 200 having the configuration in FIG. 1 are prepared, the characteristic of no reception being performed between antenna elements having different terminal orientations is exhibited. In contrast, when the terminal orientations are the same as each other, antenna elements having the same loop radius perform reception on a large scale. That is, although transmission and reception are performed between antenna elements having the same loop radius and the same terminal positions on the sides of transmission and reception, no transmission and reception are performed in another combination. This enables multiplexing using the same frequency band.

According to [Expression 7], the maximum current flows even when the antenna elements have the same loop radius and terminal dispositions are shifted by $l\pi/m_i$. The terminal orientations of reception-side antennas, which are desired to receive the maximum power, may be equal as in the above-described example, and may be shifted by $l\pi/m_i$.

In the configuration, using m=1, 2, and 3, in FIGS. 1 to 3, there are a total of six elements of three circular loop antenna elements 110, 120, and 130 of the first circular loop antenna group 100A on the upper surface and three circular loop antenna elements 140, 150, and 160 of the second circular loop antenna group 100B on the lower surface. This configuration enables six-value multiplexing by putting different signals on the antenna elements. When the terminal positions are the same as each other, the multiplexing number is limited to the number of antenna elements, having different perimeters, disposed on the same plane.

Since the current distribution is approximated in the description so far, pass characteristics are also considered to be only approximately correct. A result of actually evaluating the pass characteristics by using the transmitting antenna 100 and the receiving antenna 200 in FIGS. 1 to 3 will now be described.

Here, the antennas 1 to 6 (circular loop antenna elements 110 to 160 and 210 to 260) were disposed on a FR-4 substrate having a thickness of 0.1 mm. The loop radii of groups were 8.4 mm, 16.7 mm, and 25 mm. The perimeters in the case are 52.8 mm, 104.9 mm, and 157.1 mm, and are roughly equal to 52.7 mm, 105.3 mm, and 158.0 mm, which are roughly one time, two times, and three times of a wavelength 52.66 mm in an effective relative dielectric constant of 1.2 and a frequency of 5.2 GHz. The distance between the surface (upper surface) where the antennas 1 to 3 of the first circular loop antenna group 100A are disposed and the surface (lower surface) where the antennas 4 to 6 of the second circular loop antenna group 100B are disposed is 10 mm. The terminal impedance of each antenna element is 100Ω.

FIGS. 7 to 10 illustrate the reflection characteristics (FIG. 7) and the pass characteristics (FIGS. 8 to 10) between elements in the case where the angular positions (disposition directions) of all terminals of the antennas 1 to 6 (circular loop antenna elements 110 to 160 and 210 to 260) are all the same.

As illustrated in FIG. 1, FIGS. 11 to 14 illustrate the reflection characteristics (FIG. 11) and pass characteristics (FIGS. 12 to 14) between elements in the case where the angular position (disposition direction) of a terminal of each of the antennas 1 to 6 is set (i.e., in the case of a structure in which terminal positions of the antennas 4 to 6 are shifted by π/2, π/4, and π/6 from terminal positions of the antennas 1 to 3 on the upper surface).

Figure 7:
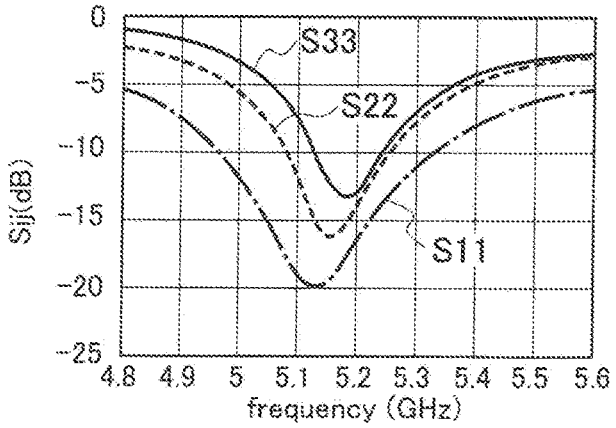
FIG. 7 is a characteristic diagram illustrating an example of reflection loss of the antenna in the case where terminal positions, where the power supply unit is connected, are the same.
Figure 8:
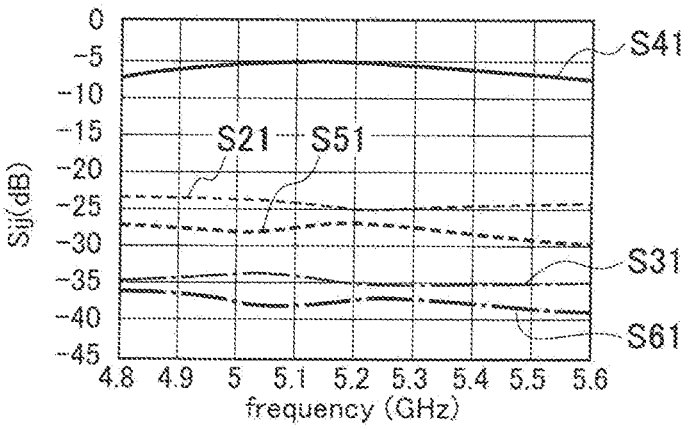
FIG. 8 is a characteristic diagram illustrating an example (when an antenna 1 is excited) of the pass characteristics between elements in the case where the terminal positions where the power supply unit is connected are the same.
Figure 9:
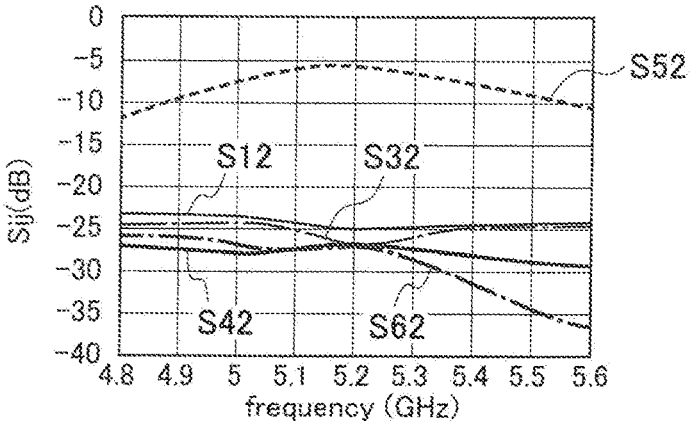
FIG. 9 is a characteristic diagram illustrating an example (when an antenna 2 is excited) of the pass characteristics between elements in the case where the terminal positions, where the power supply unit is connected, are the same.
Figure 10:
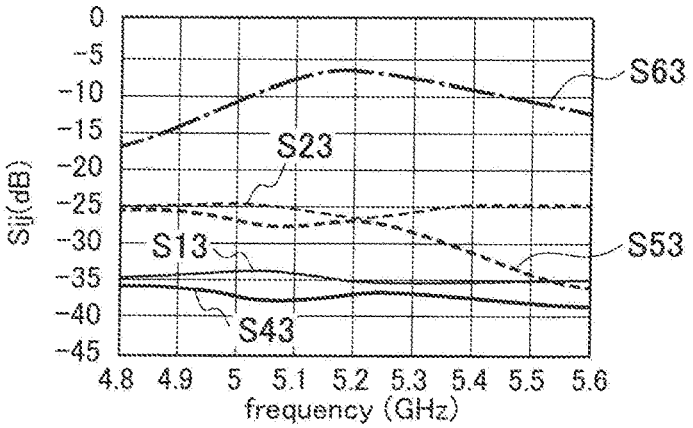
FIG. 10 is a characteristic diagram illustrating an example (when an antenna 3 is excited) of the pass characteristics between elements in the case where the terminal positions, where the power supply unit is connected, are the same.
Figure 11:
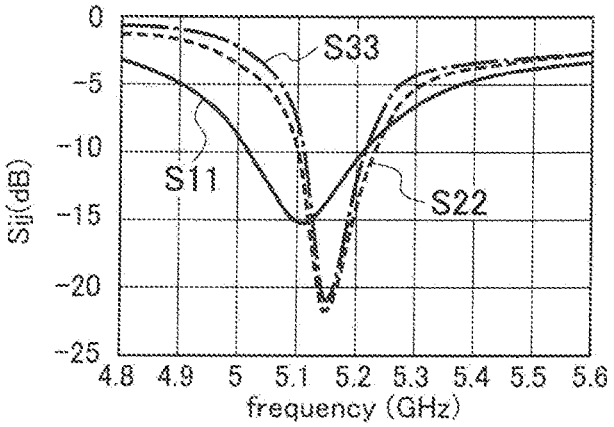
FIG. 11 is a characteristic diagram illustrating an example of the reflection loss of the antenna according to the first embodiment of the invention.
Figure 12:
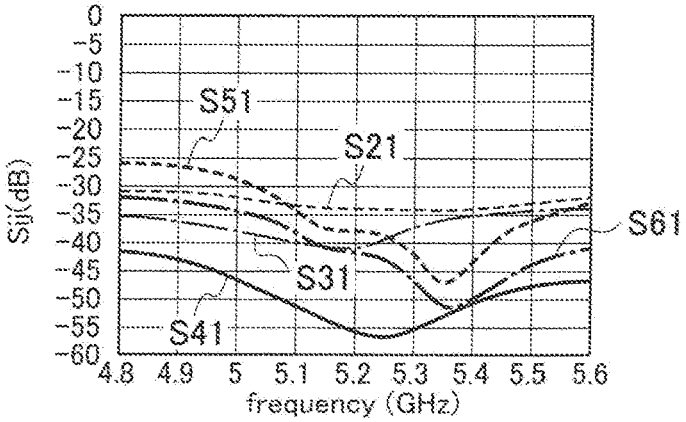
FIG. 12 is a characteristic diagram illustrating an example (when the antenna 1 is excited) of the pass characteristics between elements of the antenna according to the first embodiment of the invention.
Figure 13:
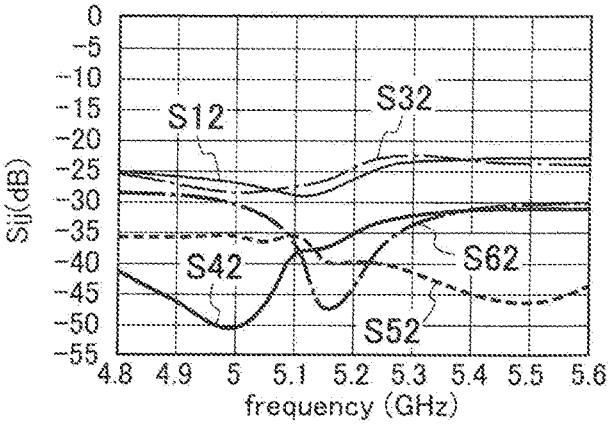
FIG. 13 is a characteristic diagram illustrating an example (when the antenna 2 is excited) of the pass characteristics between elements of the antenna according to the first embodiment of the invention.
Figure 14:
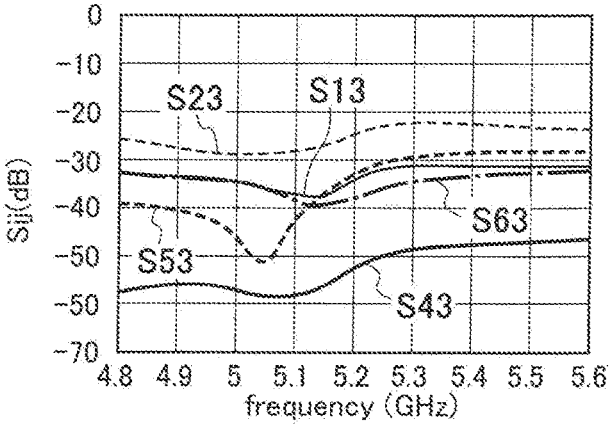
FIG. 14 is a characteristic diagram illustrating an example (when the antenna 3 is excited) of the pass characteristics between elements of the antenna according to the first embodiment of the invention.

FIGS. 7 and 11 in FIGS. 7 to 14 illustrate the reflection loss of the transmitting antenna 100. FIGS. 8 and 12 illustrate the pass characteristics in the case where the antenna 1 is excited. FIGS. 9 and 13 illustrate the pass characteristics in the case where the antenna 2 is excited. FIGS. 10 and 14 illustrate the pass characteristics in the case where the antenna 3 is excited.

For example, reflection loss S11 in FIGS. 7 and 11 indicates reflection loss of the antenna 1 of the transmitting antenna 100. Reflection loss S22 indicates reflection loss of the antenna 2 of the transmitting antenna 100. Reflection loss S33 indicates reflection loss of the antenna 3 of the transmitting antenna 100.

Pass characteristics S21, S31, S41, S51, and S61 in FIGS. 8 and 12 respectively indicate the pass characteristics of the antennas 2, 3, 4, 5, and 6 in the case where the antenna 1 is excited.

As illustrated in FIG. 7, good reflection loss is obtained when the terminal positions are the same as each other. As illustrated in FIGS. 8 to 10, however, isolation is poor between antenna elements having an equal loop radius. Specifically, for example, a characteristic S41 in FIG. 8, a characteristic S52 in FIG. 9, and a characteristic S63 in FIG. 10 are approximately 5 dB in the vicinity of 5.2 GHz.

In contrast, for example, a characteristic S41 in FIG. 12, a characteristic S52 in FIG. 13, and a characteristic S63 in FIG. 14 are −30 dB or less in the vicinity of 5.2 GHz in the characteristics of the transmitting antenna 100 of the embodiment. Consequently, a value larger than the isolation between elements having different loop radii on the same plane is obtained. Large isolation can be obtained even in elements (e.g., antennas 1 and 4) having the same loop radius.

A passage amount from other than a desired antenna at 5.2 GHz is approximately −20 dB as illustrated in FIG. 11, and this can be said to be small. Considering that a signal is put on a carrier radiated from each antenna, the carrier is an interference wave. Reducing the interference waves as small as possible is important in improving communication performance.

Characteristics between the transmitting antenna 100 and the receiving antenna 200 will now be described.

Figure 15:
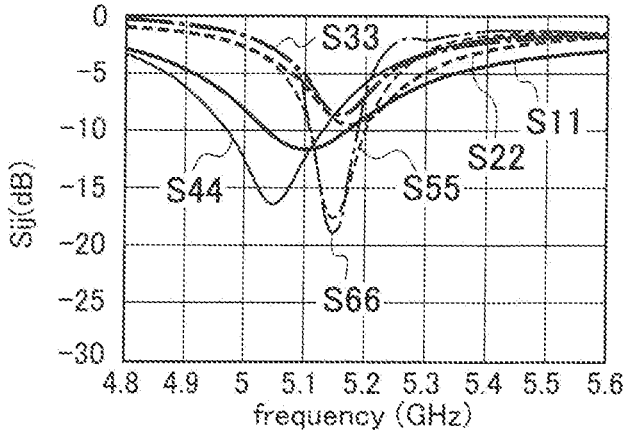
FIG. 15 is a characteristic diagram illustrating an example of reflection loss in the case where the angular positions of terminals for connecting a power supply unit are the same in the first and second circular loop antenna groups.
Figure 16:
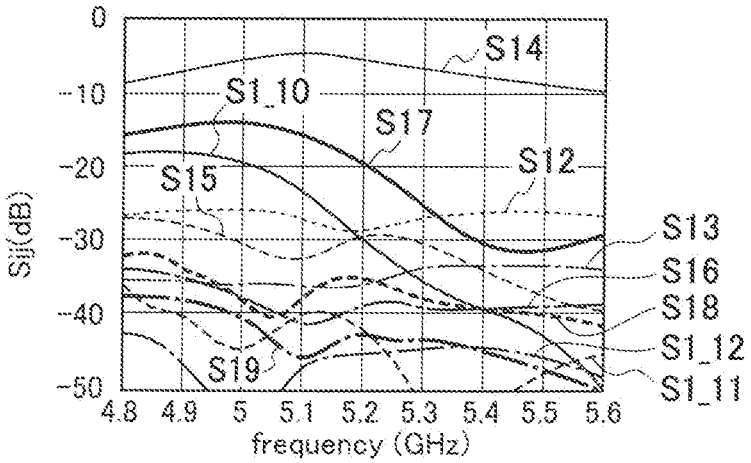
FIG. 16 is a characteristic diagram illustrating an example (when the antenna 1 is excited) of pass characteristics in the case where the angular positions of terminals for connecting a power supply unit are the same in the first and second circular loop antenna groups.
Figure 17:
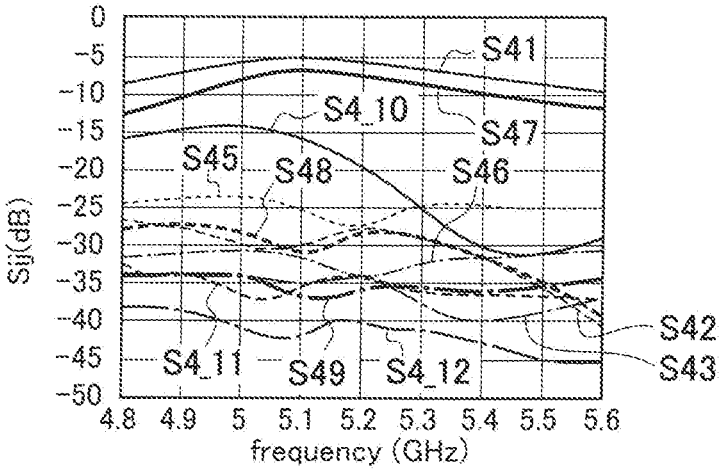
FIG. 17 is a characteristic diagram illustrating an example (when an antenna 4 is excited) of pass characteristics in the case where the angular positions of terminals for connecting a power supply unit are the same in the first and second circular loop antenna groups.
Figure 19:
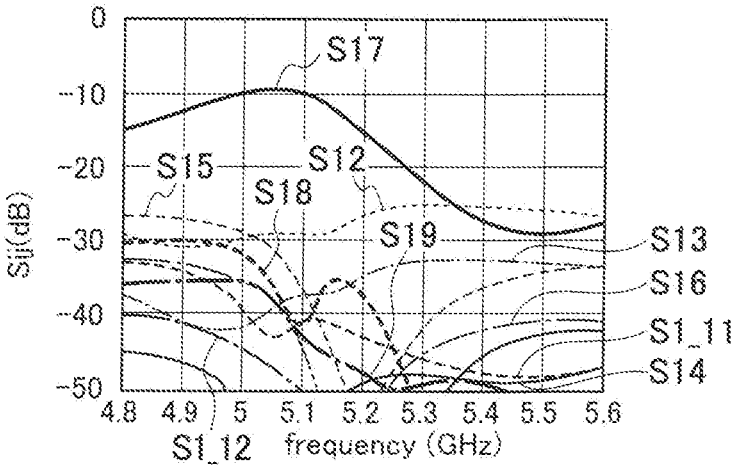
FIG. 19 is a characteristic diagram illustrating an example (when the antenna 1 is excited) of pass characteristics of the antenna (loop radius of the excitation antenna: 8.4 mm) according to the first embodiment of the invention.
Figure 20:
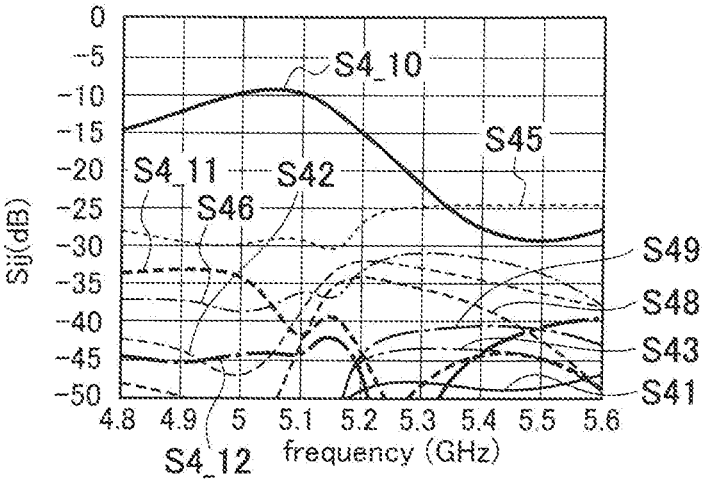
FIG. 20 is a characteristic diagram illustrating an example (when the antenna 4 is excited) of pass characteristics of the antenna (loop radius of the excitation antenna: 8.4 mm) according to the first embodiment of the invention.
Figure 21:
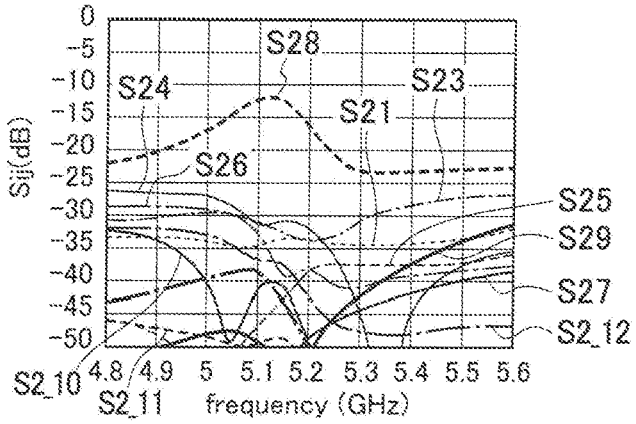
FIG. 21 is a characteristic diagram illustrating an example (when the antenna 2 is excited) of a pass characteristic between elements of the antenna (loop radius of the excitation antenna: 16.7 mm and 25 mm) according to the first embodiment of the invention.
Figure 22:
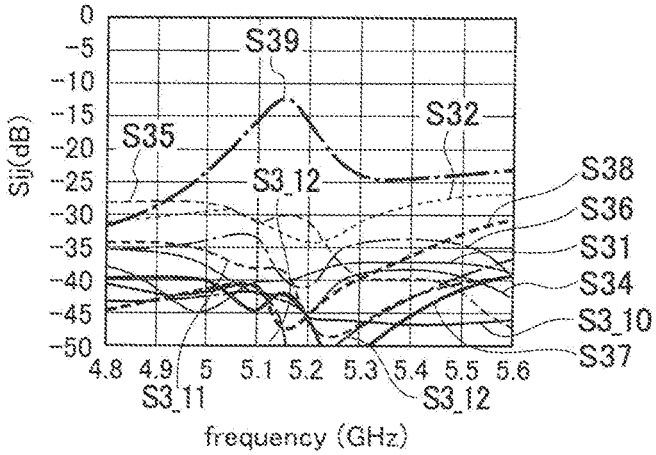
FIG. 22 is a characteristic diagram illustrating an example (when the antenna 3 is excited) of a pass characteristic between elements of the antenna (loop radius of the excitation antenna: 16.7 mm and 25 mm) according to the first embodiment of the invention.
Figure 23:
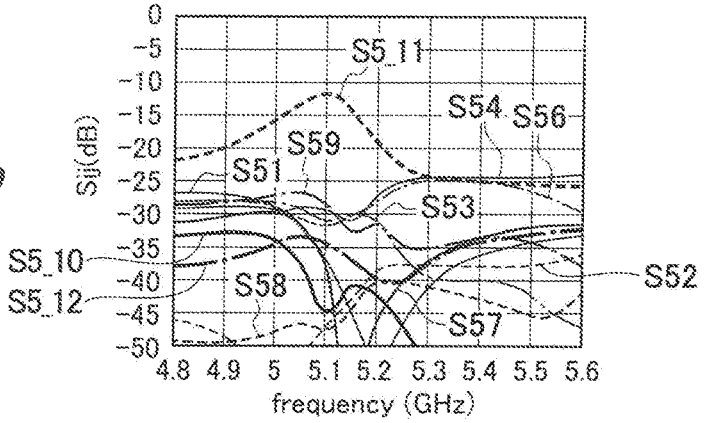
FIG. 23 is a characteristic diagram illustrating an example (when an antenna 5 is excited) of a pass characteristic between elements of the antenna (loop radius of the excitation antenna: 16.7 mm and 25 mm) according to the first embodiment of the invention.
Figure 24:
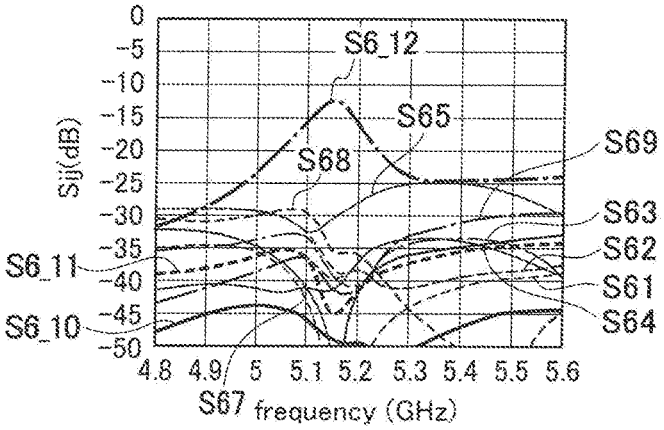
FIG. 24 is a characteristic diagram illustrating an example (when an antenna 6 is excited) of a pass characteristic between elements of the antenna (loop radius of the excitation antenna: 16.7 mm and 25 mm) according to the first embodiment of the invention.

FIGS. 15 to 17 illustrate reflection loss and pass characteristics in the case of antenna elements having the same angular position (azimuth) of a terminal. In contrast, FIGS. 18 to 20 illustrate reflection loss and pass characteristics in the case where the angular position (azimuth) of a terminal is changed as illustrated in FIG. 1.

Here, the six circular loop antenna elements 110 to 160 of the transmitting antenna 100 are referred to as antennas 1 to 6, and the six circular loop antenna elements 210 to 260 of the receiving antenna 200 are referred to as antennas 7 to 12.

The distance between the surface on which the transmission circular loop antenna group 100A in FIG. 1 is disposed and the surface on which the transmission circular loop antenna group 100B is disposed is 10 mm, and the distance L between the transmitting and receiving antennas is 30 mm. The distance between the surface on which the reception circular loop antenna group 200A is disposed and the surface on which the reception circular loop antenna group 200B is disposed is also 10 mm.

Figure 18:
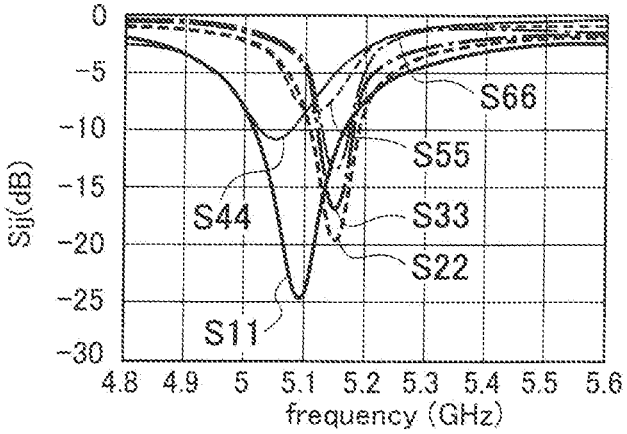
FIG. 18 is a characteristic diagram illustrating an example of reflection loss of the antenna (loop radius of an excitation antenna: 8.4 mm) according to the first embodiment of the invention.

The reflection losses in FIGS. 15 and 18 indicate the reflection characteristics of the transmitting antenna 100. For example, the characteristic S11 indicates the reflection characteristics of the transmitting antenna 100 at the antenna 1 (element 110).

FIGS. 16, 17, 19, and 20 illustrate the pass characteristics in the case where the antennas 1 and 4 (elements 110 and 140) of the transmitting antenna 100 are excited. For example, a characteristic S12 indicates a pass characteristic from the antenna 1 (element 110) of the transmitting antenna 100 to the antenna 2 (element 120) of the transmitting antenna 100. A characteristic S17 indicates a pass characteristic from the antenna 1 (element 110) of the transmitting antenna 100 to the antenna 7 (element 210) of the receiving antenna 200.

As illustrated in FIGS. 15 to 17, in the pass characteristics in the case where two elements having the same terminal direction are arranged, the passage amount is maximized in both the examples in FIGS. 16 and 17 when the elements have the same loop radius as an excitation antenna and are the closest to each other. For example, a pass characteristic S14 is maximized in the example of FIG. 16. A pass characteristic S41 is maximized in the example of FIG. 17. Pass characteristics S17, S1_10, S47, and S4_10 to the receiving antenna 200 are small even with the same loop radius. This is because terminals are disposed in the same direction so that passage in the receiving antenna 200 cannot be inhibited, and a signal put on the antennas 1 and 4 (elements 110 and 140) of the transmitting antenna 100 is transmitted in the receiving antenna. When this is ignored and passage amounts from the transmitting antenna 100 to the antennas 7 to 10 (elements 210 and 240) of the receiving antenna 200 are compared, passage (S17 and S47) to the closer antenna 7 is larger than that to the farther antenna 10 as illustrated in FIGS. 16 and 17. This causes multiplexing impossible.

In contrast, in the examples of FIGS. 18 to 20, when viewed in the vicinity of 5.15 GHz of good reflection loss, the pass characteristic S17 exhibits the maximum passage amount in the example (excitation antenna 1) of FIG. 19, and the pass characteristic S4_10 exhibits the maximum passage amount in the example (excitation antenna 4) of FIG. 20. In the displayed frequency range, S1_10 and S47 are −50 dB or less, and do not appear in FIGS. 18 to 20.

That is, despite the close distance between the antennas 1 and 4 in the transmitting antenna 100, passage is maximized between an antenna of the transmitting antenna 100 on the lower surface and an antenna of the receiving antenna 200 on the lower surface, or between an antenna of the transmitting antenna on the upper surface and an antenna of the receiving antenna on the upper surface. Shifting terminal disposition in this way inhibits passage to another element in the transmitting antenna, and maximizes passage between antenna elements having both of an aligned loop radius and terminal direction between the transmitting antenna and the receiving antenna. This indicates that multiplexing is possible.

FIGS. 18 to 20 illustrate the characteristics of the antennas 1 and 4 (elements 110 and 140) of the transmitting antenna 100 having a loop radius of 8.4 mm. FIGS. 21 to 24 illustrate the characteristics of the transmitting antennas 2, 3, 5, and 6. When the excitation antenna is the antenna 2 (FIG. 21), a pass characteristic S28 in the case with the antenna 8 of the receiving antenna 200 having the same loop radius and terminal direction is maximized. Similarly, a characteristic S39 (FIG. 22) when the excitation antenna is the antenna 3, a characteristic S5_11 (FIG. 23) when the excitation antenna is the antenna 5, and a characteristic S6_12 (FIG. 24) when the excitation antenna is the antenna 6 are maximized. Passage is maximized between elements having both of the same loop radius and terminal direction between the transmitting antenna 100 and the receiving antenna 200. Passage between other antennas is −27 dB at 5.15 GHz. When each element of the transmitting antenna 100 is excited, the difference between the maximum passage amount and the second passage amount is 14.1 dB or more (S5_11-S56) even at the minimum value in all cases. Transmission signals on respective systems can be sufficiently separated, and six-value multiplexing is possible by using six transmission systems.

As described above, the transmitting antenna 100 and the receiving antenna 200 of the embodiment can inhibit passage amount between two antennas having an equal loop radius by shifting an angular position (orientation) of a terminal by a desired value even when each element has an equal loop radius. For example, the antenna elements having three types of loop radii as illustrated in FIG. 1 enables six-value multiplexing of twice the number of types of loop radii.

In the embodiment, the frequencies transmitted by respective antenna elements are the same, and transmission data amount can be increased in proportion to the disposition number of the circular loop antenna elements in a simple configuration that does not need a traditional phase shifter even in a single frequency band. Each circular loop antenna element selectively radiates and accepts a substantially single mode of electromagnetic field, so that each of the reception units 51 to 56 can retrieve reception data only by demodulating a reception signal of each circular loop antenna element. Special processing for separating data of a plurality of systems is thus unnecessary. The circuit configurations of the transmission units 21 to 26 and the reception units 51 to 56 are very simple.

According to the first embodiment, wireless communication with an improved transmission rate per frequency can be achieved by using an inexpensive antenna device having a simple structure and being excellent in mass productivity. Furthermore, in the first embodiment, a transmission unit and a reception unit connected to the antenna device does not need the special configuration for separating and mixing signals on a plurality of systems. This enables wireless communication with an improved transmission rate per frequency with a simple configuration of the entire wireless communication apparatus.

Although an example in which three types of loop radii are prepared has been described here, the types of loop radii are not limited to three, and two or four or more types may be prepared.

2. Second Embodiment

A second embodiment of the invention will now be described with reference to FIGS. 25 to 38.

In FIGS. 25 to 38 for describing the second embodiment, the same signs are attached to the same members as those in the first embodiment described with reference to FIGS. 1 to 24, and the detailed description thereof will be omitted.

[2-1. Configuration of Antenna Device]

Figure 25:
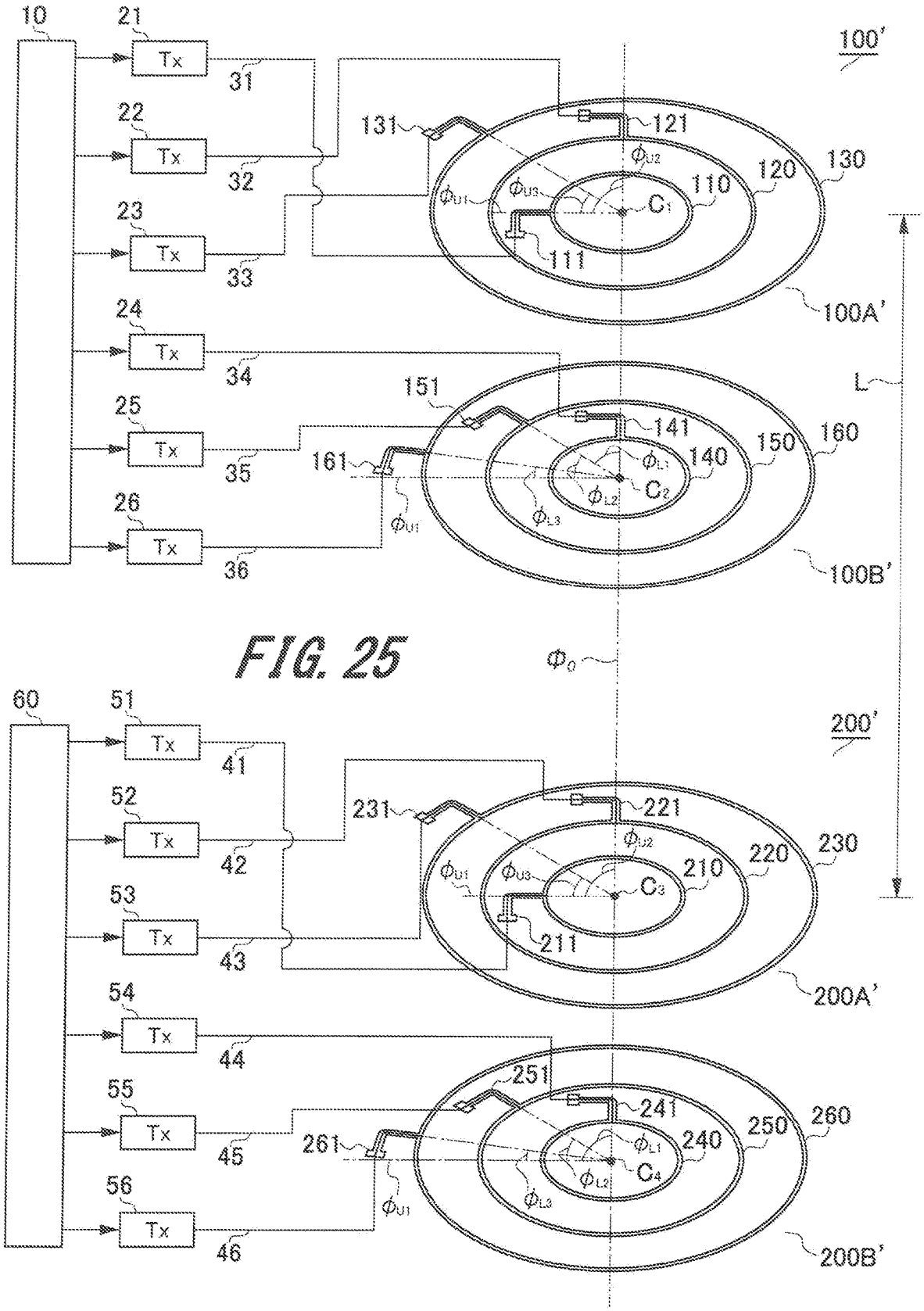
FIG. 25 is a configuration diagram illustrating an example of the entire configuration of a wireless communication apparatus according to a second embodiment of the invention.

FIG. 25 illustrates the configurations of a transmitting antenna 100' and a receiving antenna 200' of the embodiment and a transmission system and a reception system connected thereto.

Figure 26:
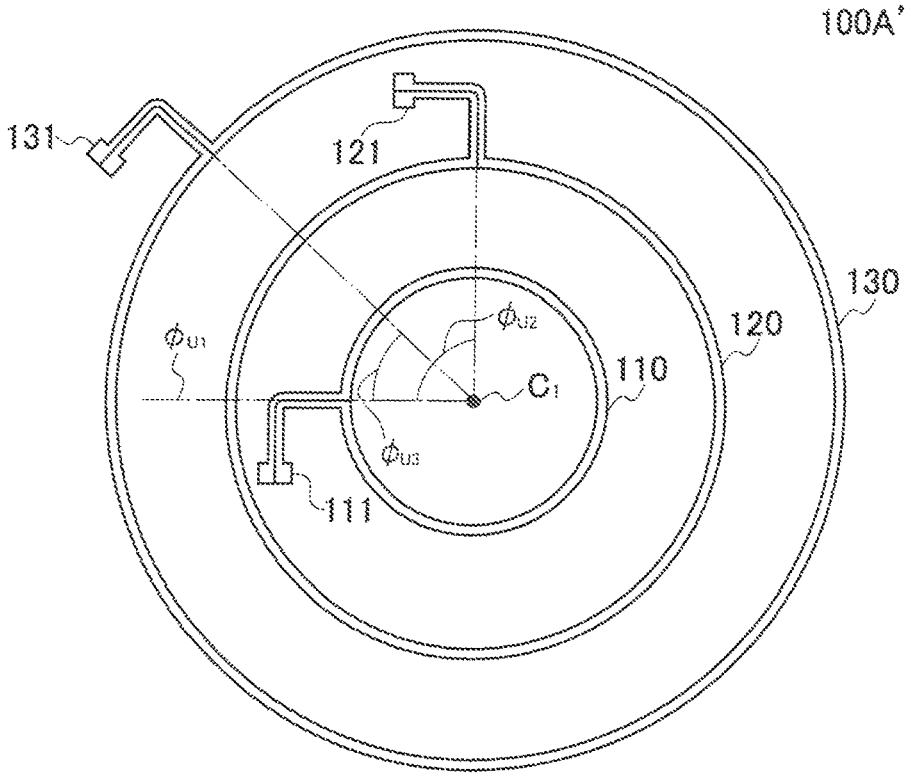
FIG. 26 is a plan view illustrating antenna configuration (upper surface pattern) according to the second embodiment of the invention.
Figure 27:
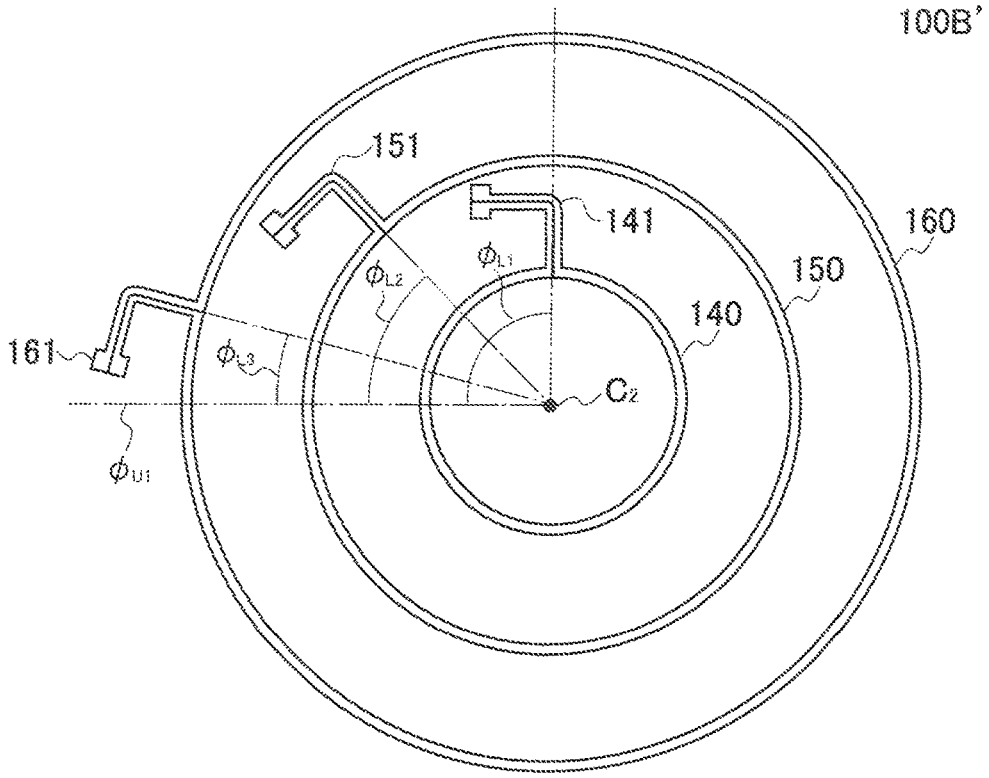
FIG. 27 is a plan view illustrating antenna configuration (lower surface pattern) according to the second embodiment of the invention.

FIGS. 26 and 27 are plan views of a first circular loop antenna group 100A' (FIG. 26) of the transmitting antenna 100' and a second circular loop antenna group 100B' (FIG. 27) on the lower surface side.

In the second embodiment, the first circular loop antenna group 100A' on the upper surface side and the second circular loop antenna group 100B' on the lower surface side are provided as the transmitting antenna 100', and each group includes three circular loop antenna elements 110 to 130 or 140 to 160. This point is the same as in the transmitting antenna 100 of the first embodiment. A first circular loop antenna group 200A' on the upper surface side and a second circular loop antenna group 200B' on the lower surface side are provided as the receiving antenna 200', and each group includes three circular loop antenna elements 210 to 230 or 240 to 260. This point is also the same as in the receiving antenna 200 of the first embodiment. Conditions such as the perimeter of each antenna element are also the same as those in the first embodiment.

As in the example in FIG. 1, the transmitting antenna 100' and the receiving antenna 200' are disposed such that the center of each of the antenna groups 100A', 100B', 200A', and 200B' passes through the same central axis $\varphi_0$.

Transmission units 21 to 26 respectively connected to the circular loop antenna elements 110 to 160 of the transmitting antenna 100' and reception units 51 to 56 respectively connected to the circular loop antenna elements 210 to 260 of the receiving antenna 200' are also the same as those in the first embodiment. All the circular loop antenna elements 110 to 160 transmit signals having the same frequency band.

In the second embodiment, angular positions where power supply units 111 to 161 and 211 to 261 are respectively connected to the circular loop antenna elements 110 to 160 and 210 to 260 are different from those in the first embodiment.

Here, as illustrated in FIGS. 26 and 27, each of connection positions (terminal positions) of the power supply units 111 to 131 of the three circular loop antenna elements 110 to 130 on the upper surface of the transmitting antenna 100' and connection positions (terminal positions) of the power supply units 141 to 161 of the three circular loop antenna elements 140 to 160 on the lower surface is rotated by $(2l+1)\pi/2m_i$. This point is the same as in the first embodiment.

The feature of the second embodiment is that, when the connection positions of the power supply units 111, 121, and 131 of the three circular loop antenna elements 110, 120, and 130 on the upper surface are defined as $\varphi_{U1}$, $\varphi_{U2}$, and $\varphi_{U3}$ and the reference angular position is set to 0, for example, $\varphi_{U1}=0$, $\varphi_{U2}=\pi/2$, and $\varphi_{U3}=\pi/4$ hold, and the connection positions are not in the same direction.

At this time, the connection positions of the power supply units 141, 151, and 161 of the three circular loop antenna elements 140, 150, and 160 on the lower surface are defined as $\varphi_{L1}$, $\varphi_{L2}$, and $\varphi_{L3}$, and $\varphi_{L1}=\pi/2$, $\varphi_{L2}=\pi/4$, and $\varphi_{L3}=\pi/12$ hold. In the case, the angular positions of terminals of the elements 110 and 140, which have the same perimeter, are shifted by $\pi/2$. The angular positions of terminals of the elements 120 and 150 are shifted by $\pi/4$. The angular positions of terminals of the elements 130 and 160 are shifted by $\pi/6$.

Although FIGS. 26 and 27 illustrate the connection positions (angular positions) of the power supply units 111 to 161 of the transmitting antenna 100', the connection positions (angular positions) of the power supply units 211 to 216 of the receiving antenna 200' are also set similarly to those of the transmitting antenna 100'.

[2-2. Operation Characteristics of Antenna Device]

Operation characteristics of the transmitting antenna 100' and the receiving antenna 200' of the embodiment will now be described with reference to FIGS. 28 to 38. In this case as well, similarly to the first embodiment, the six circular loop antenna elements 110 to 160 on the transmission side are referred to as the antennas 1 to 6, and the six circular loop antenna elements 110 to 160 on the reception side are referred to as the antennas 7 to 12.

First, FIGS. 28 to 31 illustrate the results of evaluating the characteristics of the transmitting antenna 100'. Here, each of the circular loop antenna elements 110, 120, 130, 140, 150, and 160 is disposed on a substrate called FR-4 with a thickness of 0.1 mm. Three elements of each group have loop radii of 8.4 mm, 16.7 mm, or 25 mm. Conductor widths d are all 0.4 mm. The distance between the upper surface on which the first circular loop antenna group is disposed and the lower surface on which the second circular loop antenna group is disposed is set to 10 mm. The terminal impedance of each antenna element is 100Ω.

Figure 28:
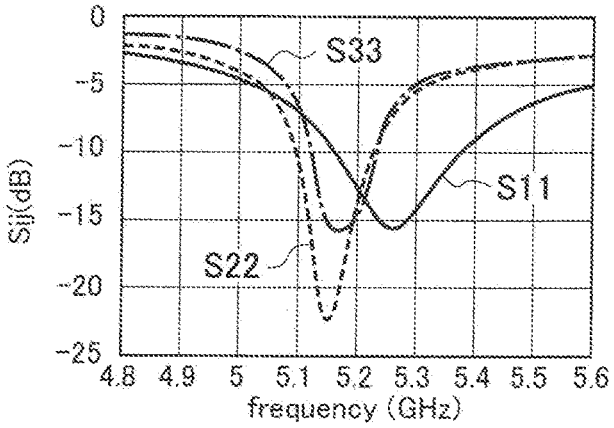
FIG. 28 is a characteristic diagram illustrating an example of the reflection loss of the antenna according to the second embodiment of the invention.

Reflection loss S11 in FIG. 28 indicates reflection loss of the antenna 1 of the transmitting antenna 100. Reflection loss S22 indicates reflection loss of the antenna 2 of the transmitting antenna 100. Reflection loss S33 indicates reflection loss of the antenna 3 of the transmitting antenna 100.

Figure 29:
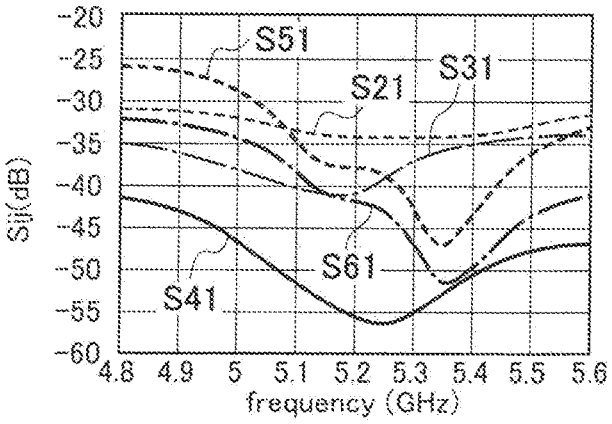
FIG. 29 is a characteristic diagram illustrating an example (when the antenna 1 is excited) of the pass characteristics between transmitting antennas according to the second embodiment of the invention.

Pass characteristics S21, S31, S41, S51, and S61 in FIG. 29 respectively indicate the pass characteristics to the antennas 2, 3, 4, 5, and 6 in the case where the antenna 1 is excited. Pass characteristics S12, S32, S42, S52, and S62 in FIG. 30 respectively indicate the pass characteristics to the antennas 1, 3, 4, 5, and 6 in the case where the antenna 2 is excited. Pass characteristics S13, S23, S43, S53, and S63 in FIG. 31 respectively indicate the pass characteristics to the antennas 1, 2, 4, 5, and 6 in the case where the antenna 3 is excited.

Figure 30:
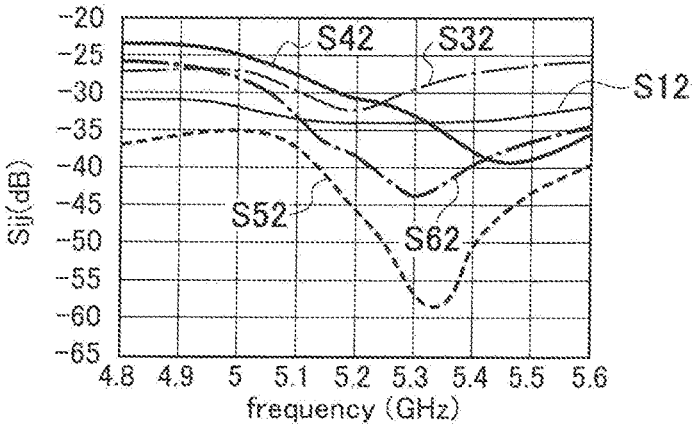
FIG. 30 is a characteristic diagram illustrating an example (when the antenna 2 is excited) of the pass characteristics between the transmitting antennas according to the second embodiment of the invention.
Figure 31:
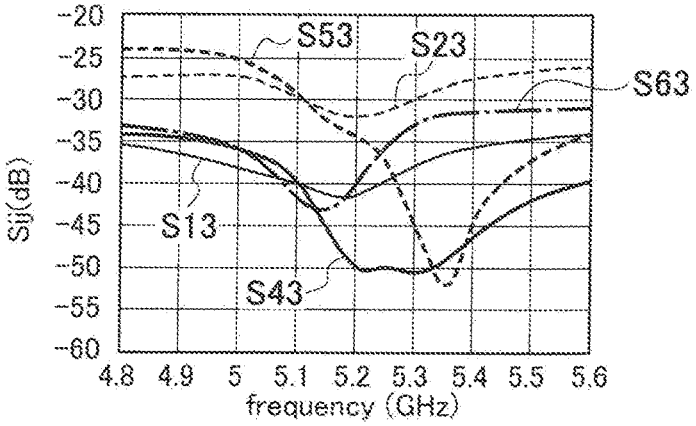
FIG. 31 is a characteristic diagram illustrating an example (when the antenna 3 is excited) of the pass characteristics between transmitting antennas according to the second embodiment of the invention.

In FIGS. 7 to 10, which are examples of the case where the terminal positions on the upper surface have the same angle as described in the first embodiment, the maximum value of passage between different antenna elements at 5.2 GHz is −23.3 dB of S23 in the case where the antenna 3 is excited. In contrast, in the case of the transmitting antenna 100' of the second embodiment, for example, as illustrated in FIG. 30, the maximum value is −30.7 dB at a characteristic S42 in the case where the antenna 2 is excited. The passage amount to another antenna in the same group is inhibited by 7.4 dB.

Characteristics between the transmitting antenna 100' and the receiving antenna 200' in the second embodiment will now be described.

Figure 32:
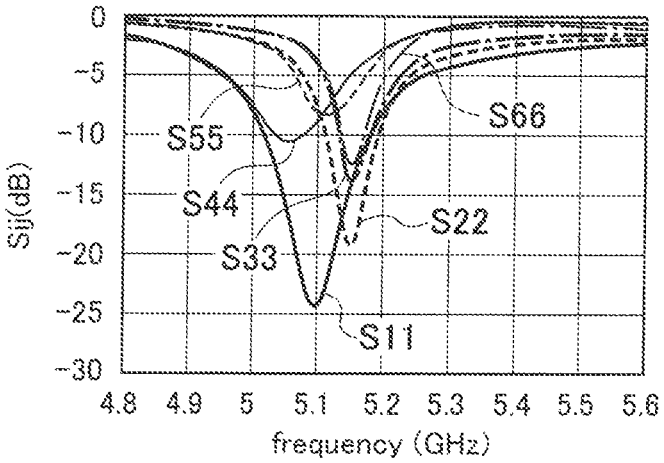
FIG. 32 is a characteristic diagram illustrating an example of the reflection loss of the antenna according to the second embodiment of the invention.
Figure 33:
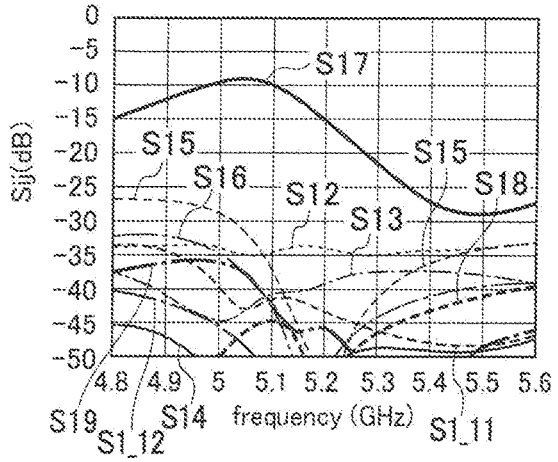
FIG. 33 is a characteristic diagram illustrating an example (when the antenna 1 is excited) of the pass characteristics between elements of the antenna according to the second embodiment of the invention.
Figure 34:
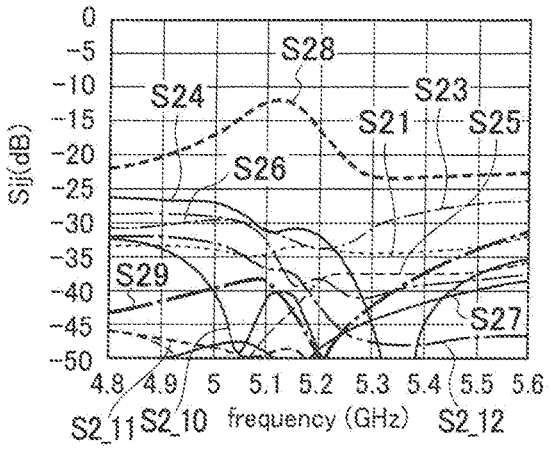
FIG. 34 is a characteristic diagram illustrating an example (when the antenna 2 is excited) of the pass characteristics between elements of the antenna according to the second embodiment of the invention.
Figure 35:
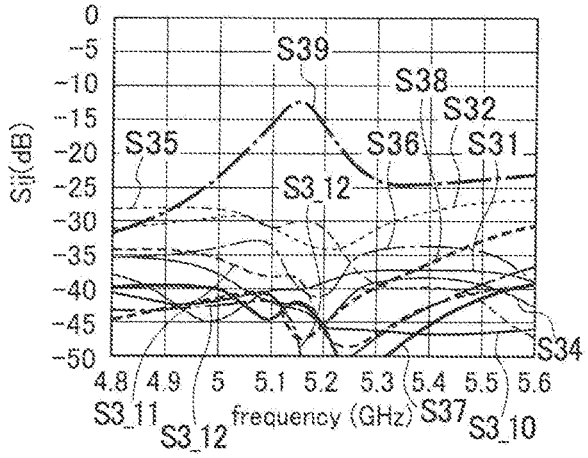
FIG. 35 is a characteristic diagram illustrating an example (when the antenna 3 is excited) of the pass characteristics between elements of the antenna according to the second embodiment of the invention.
Figure 36:
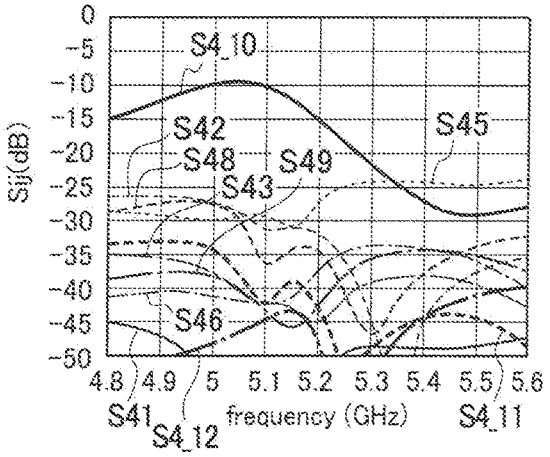
FIG. 36 is a characteristic diagram illustrating an example (when the antenna 4 is excited) of the pass characteristics between elements of the antenna according to the second embodiment of the invention.
Figure 37:
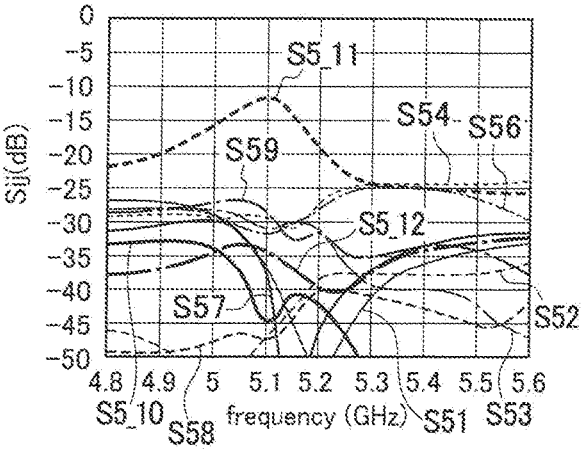
FIG. 37 is a characteristic diagram illustrating an example (when the antenna 5 is excited) of the pass characteristics between elements of the antenna according to the second embodiment of the invention.
Figure 38:
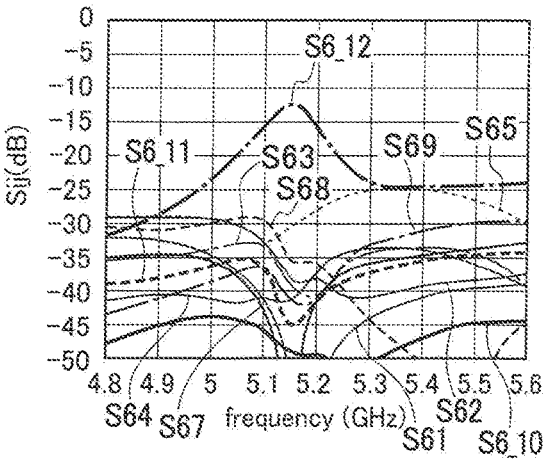
FIG. 38 is a characteristic diagram illustrating an example (when the antenna 6 is excited) of the pass characteristics between elements of the antenna according to the second embodiment of the invention.

FIG. 32 illustrates reflection loss. FIGS. 33 to 38 illustrate the pass characteristics between the transmitting antenna 100' and the receiving antenna 200'. Here, FIG. 33 illustrates a case where the antenna 1 (element 110) is excited. FIG. 34 illustrates a case where the antenna 2 (element 120) is excited. FIG. 35 illustrates a case where the antenna 3 (element 130) is excited. FIG. 36 illustrates a case where the antenna 4 (element 140) is excited. FIG. 37 illustrates a case where the antenna 5 (element 150) is excited. FIG. 38 illustrates a case where the antenna 6 (element 160) is excited.

In any case, the passage amount is maximized in characteristics S17, S28, S39, S4_10, S5_11, and S6_12, in which loop radii and terminal angles are equal. Passage amounts of other characteristics are small. This enables six-value multiplexing. The second largest passage amount is −30 dB at 5.15 GHz. The difference between the maximum passage amount and the second passage amount is 15.6 dB or more (S5_11-S56) even at the minimum value in all cases. The characteristic is 1.5 dB larger than 14.1 dB or more (see FIGS. 21 to 24) of the value that has been indicated as an antenna characteristics of the first embodiment. It can be seen that the transmitting antenna 100' and the receiving antenna 200' of the second embodiment are further excellent in characteristics.

According to the second embodiment, effects similar to those described in the above-described first embodiment can be obtained. In the second embodiment, antenna characteristics better than those in the first embodiment can be achieved.

3. Variation

The configuration of the embodiment described so far can be varied or changed without changing the spirit of the invention.

For example, although the number of the circular loop antenna elements 110 to 160 and 210 to 260 disposed in the transmitting antenna 100 or the receiving antenna 200 is set to 6 elements in total of three elements in each one group, a transmitting antenna and a receiving antenna, in which any number other than six of plurality of elements is disposed, may be used in accordance with a necessary transmission rate.

The specific angles of the terminal positions $\varphi_{U1}$, $\varphi_{U2}$, and $\varphi_{U3}$ where power supply units are connected to elements in the second embodiment are examples, and other angles may be set in accordance with the difference of a loop radius or a dielectric substrate to be used. In this case, the relative terminal positions of circular loop antennas, having the same radius, on the upper surface (front surface) side and the lower surface (back surface) side are required to be set so as to be different by approximately $(2l+1)\pi/2m_i$.

In the first and second embodiments, the first antenna element group and the second antenna element group are disposed on the front surface and the back surface of the substrate 190, respectively. Similarly, the first antenna element group and the second antenna element group may be disposed on different substrates.

Furthermore, in order to increase the transmission distance between the transmitting antenna 100 (100') and the receiving antenna 200 (200'), a paraboloid, which is a reflecting member having a paraboloid surface, may be disposed in the vicinity of the transmitting antenna 100 (100'), and the paraboloid may be disposed in the vicinity of the receiving antenna 200 (200').

Although, in each embodiment, the transmitting antenna 100 (100') is used on one hand, and the receiving antenna 200 (200') is used on the other hand, the transmitting antenna 100 (100') and the receiving antenna 200 (200') have the same configuration, and thus wireless communication may be bidirectionally performed by switching between the transmission side and the reception side as needed.

When wireless communication is bidirectionally performed, transmission and reception may be simultaneously performed at the same frequency by dividing a plurality of circular loop antennas on the side of the transmitting antenna 100 (100') into two groups and respectively using one group of circular loop antennas (e.g., circular loop antenna elements 110 to 130 in FIG. 1) and the other group of circular loop antennas (e.g., circular loop antenna elements 140 to 160 in FIG. 1) for transmission and reception.

Configuration, in which a conductor reflector is added on the opposite side of a reception array in the vicinity of a transmission array and all electromagnetic fields to be radiated on the opposite side of the reception side and wasted are transmitted to the reception side, is also effective. The distance between the transmission array and the reflector is approximately ¼ to 1/20 of a wavelength at a communication frequency. It is also effective to effectively use transmission power by providing a reflector also on the reception side and confining an electromagnetic field between the transmission and reception arrays.

As described above, the relative angle of terminal orientations of a pair of antennas for performing transmission and reception in the invention may be shifted by $l\pi/m_i$. Here, l is any integer. The first embodiment illustrates the case where l=0.

REFERENCE SIGNS LIST

10 Transmission data generation unit
21 to 26 Transmission unit

31 to 36, 41 to 46 Signal line
51 to 56 Reception unit
60 Reception data processing unit
100, 100' Transmitting antenna
200, 200' Receiving antenna
100A, 100A', 200A, 200A' First circular loop antenna group
100B, 100B', 200B, 200B' Second circular loop antenna group
110, 120, 130, 140, 150, 160, 210, 220, 230, 240, 250, 260 Circular loop antenna element
111, 121, 131, 141, 211, 221, 231, 241 Power supply unit
190 Substrate
191, 192 Dielectric layer

The invention claimed is:

1. A wireless communication apparatus comprising:

a transmitting antenna; and a receiving antenna that receives a wireless signal transmitted from the transmitting antenna, wherein the transmitting antenna and the receiving antenna include:

a first circular loop antenna group in which N (N is an integer of two or more) circular loop antenna elements are concentrically disposed on a same plane, the N circular loop antenna elements having different perimeters of $m_1$, $m_2$, . . . , and $m_N$ times that are approximately integral multiples of a wavelength determined from a wireless communication frequency;

a second circular loop antenna group, in which N circular loop antenna elements concentrically disposed on a same plane different from that for the first circular loop antenna group have a same perimeter as the N circular loop antenna elements of the first circular loop antenna group; and a plurality of power supply units that are individually connected to circular loop antenna elements in each of the first and second circular loop antenna groups, a central axis of the N circular loop antenna elements of the transmitting antenna and a central axis of the N circular loop antenna elements of the receiving antenna are disposed substantially linearly, and an angular position where the power supply units are connected to circular loop antenna elements having a same perimeter is set to an angular position rotated by $(2l+1)\pi/2m_i$ (where l is any integer, and $m_i$ is a value of $m_1$ to $m_N$ that are approximately integral multiples of a wavelength) in the first and second circular loop antenna groups.

2. The wireless communication apparatus according to claim 1, wherein the N circular loop antenna elements of the first circular loop antenna group have a same angular position where the power supply units are connected, and N circular loop antenna elements of the second circular loop antenna group connect the power supply units at an angular position rotated by $(2l+1)\pi/2m_i$ with respect to the circular loop antenna elements of the first circular loop antenna group.

3. The wireless communication apparatus according to claim 2, wherein different transmission units are connected to N circular loop antenna elements in each of the first and second circular loop antenna groups of the transmitting antenna, and different reception units are connected to N circular loop antenna elements in each of the first and second circular loop antenna groups of the receiving antenna, a transmission signal to serve as a differential signal is supplied from each of the transmission units to one end and another end of each of the circular loop antenna elements of the transmitting antenna, and a reception signal to serve as a differential signal is supplied from one end and another end of each of the circular loop antenna elements of the receiving antenna to each of the reception units.

4. The wireless communication apparatus according to claim 1, wherein an angular position where the power supply units are connected to circular loop antenna elements having a same perimeter is set to an angular position rotated by $(2l+1)\pi/2m_i$ in the first and second circular loop antenna groups, angular positions where the power supply units are connected to the N circular loop antenna elements of the first circular loop antenna group are set to different positions, and angular positions where the power supply units are connected to the N circular loop antenna elements of the second circular loop antenna group are set to different positions.

5. The wireless communication apparatus according to claim 4, wherein different transmission units are connected to N circular loop antenna elements in each of the first and second circular loop antenna groups of the transmitting antenna, and different reception units are connected to N circular loop antenna elements in each of the first and second circular loop antenna groups of the receiving antenna, a transmission signal to serve as a differential signal is supplied from each of the transmission units to one end and another end of each of the circular loop antenna elements of the transmitting antenna, and a reception signal to serve as a differential signal is supplied from one end and another end of each of the circular loop antenna elements of the receiving antenna to each of the reception units.

6. The wireless communication apparatus according to claim 1, wherein different transmission units are connected to N circular loop antenna elements in each of the first and second circular loop antenna groups of the transmitting antenna, and different reception units are connected to N circular loop antenna elements in each of the first and second circular loop antenna groups of the receiving antenna, a transmission signal to serve as a differential signal is supplied from each of the transmission units to one end and another end of each of the circular loop antenna elements of the transmitting antenna, and a reception signal to serve as a differential signal is supplied from one end and another end of each of the circular loop antenna elements of the receiving antenna to each of the reception units.

7. An antenna device comprising:

a first circular loop antenna group in which N (N is an integer of two or more) circular loop antenna elements are concentrically disposed on a same plane, the N circular loop antenna elements having different perimeters of $m_1$, $m_2$, . . . , and $m_N$ times that are approximately integral multiples of a wavelength determined from a wireless communication frequency;

a second circular loop antenna group, in which N circular loop antenna elements concentrically disposed on a same plane different from that for the first circular loop antenna group have a same perimeter as the N circular loop antenna elements of the first circular loop antenna group; and a plurality of power supply units that are individually connected to circular loop antenna elements in each of the first and second circular loop antenna groups, wherein an angular position where the power supply units are connected to circular loop antenna elements having a same perimeter is set to an angular position rotated by $(2l+1)\pi/2m_i$ (where l is any integer, and $m_i$ is a value of $m_1$ to $m_N$ that are approximately integral multiples of a wavelength) in the first and second circular loop antenna groups.

8. The antenna device according to claim 7, wherein the N circular loop antenna elements of the first circular loop antenna group have a same angular position where the power supply units are connected, and N circular loop antenna elements of the second circular loop antenna group connect the power supply units at an angular position rotated by $(2l+1)\pi/2m_i$ with respect to the circular loop antenna elements of the first circular loop antenna group.

9. The antenna device according to claim 7, wherein an angular position where the power supply units are connected to circular loop antenna elements having a same perimeter is set to an angular position rotated by $(2l+1)\pi/2m_i$ in the first and second circular loop antenna groups, angular positions where the power supply units are connected to the N circular loop antenna elements of the first circular loop antenna group are set to different positions, and angular positions where the power supply units are connected to the N circular loop antenna elements of the second circular loop antenna group are set to different positions.

* * * * *